US008558767B2

(12) United States Patent
Kwon

(10) Patent No.: US 8,558,767 B2
(45) **Date of Patent: *Oct. 15, 2013**

(54) ORGANIC LIGHT EMITTING DISPLAY AND DRIVING METHOD THEREOF

(75) Inventor: Oh-Kyong Kwon, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 1192 days.

This patent is subject to a terminal disclaimer.

(21) Appl. No.: 12/124,250

(22) Filed: May 21, 2008

(65) Prior Publication Data

US 2009/0051628 A1 Feb. 26, 2009

(30) Foreign Application Priority Data

Aug. 23, 2007 (KR) ..... 10-2007-0084730

(51) Int. Cl.
*G09G 3/30* (2006.01)
*G09G 3/10* (2006.01)

(52) U.S. Cl.
USPC ..... 345/77; 345/76; 315/169.3

(58) Field of Classification Search
USPC ..... 345/76–83, 204–215; 315/169.1–169.4
See application file for complete search history.

(56) References Cited

U.S. PATENT DOCUMENTS

| | | | | |
|---|---|---|---|---|
| 6,518,962 | B2 | 2/2003 | Kimura et al. | |
| 6,911,781 | B2 | 6/2005 | Yamazaki et al. | |
| 7,113,156 | B2 | 9/2006 | Hashimoto | |
| 7,456,812 | B2 | 11/2008 | Smith et al. | |
| 7,518,577 | B2 | 4/2009 | Akimoto et al. | |
| 7,667,674 | B2 | 2/2010 | Sato et al. | |
| 7,675,492 | B2 | 3/2010 | Park et al. | |
| 7,760,171 | B2 * | 7/2010 | Kwon | 345/82 |
| 2002/0075208 | A1 * | 6/2002 | Bae et al. | 345/76 |
| 2004/0108518 | A1 | 6/2004 | Jo | |
| 2005/0017934 | A1 | 1/2005 | Chung et al. | |
| 2005/0099368 | A1 * | 5/2005 | Abe et al. | 345/76 |
| 2005/0179625 | A1 | 8/2005 | Choi et al. | |
| 2006/0139264 | A1 | 6/2006 | Choi et al. | |

(Continued)

FOREIGN PATENT DOCUMENTS

| | | | |
|---|---|---|---|
| EP | 1 130 565 | A1 | 9/2001 |
| EP | 1 752 955 | A1 | 2/2007 |

(Continued)

OTHER PUBLICATIONS

Notice of Allowance dated Mar. 31, 2009 for corresponding Korean Patent Application No. 10-2007-0084730 listing cited references.

(Continued)

*Primary Examiner* — Vijay Shankar
*Assistant Examiner* — Patrick F Marinelli
(74) *Attorney, Agent, or Firm* — Christie, Parker & Hale, LLP

(57) ABSTRACT

An organic light emitting display device includes: a plurality of pixels at crossing portions of data lines, scan lines, and emission control lines; a sensor for sensing degradation information of organic light emitting diodes and mobility information of driving transistors, which are included in each pixel; a converter for storing the degradation information of organic light emitting diodes and the mobility information of driving transistors, which are sensed utilizing the sensor and converting input data to corrected data by utilizing the stored information; and a data driver receiving the corrected data and generating data signals to be supplied.

30 Claims, 20 Drawing Sheets

(56) References Cited

U.S. PATENT DOCUMENTS

| | | | | |
|---|---|---|---|---|
| 2007/0018917 | A1 | 1/2007 | Miyazawa | |
| 2007/0024540 | A1* | 2/2007 | Ryu et al. | 345/76 |
| 2007/0024541 | A1* | 2/2007 | Ryu et al. | 345/76 |
| 2007/0024542 | A1* | 2/2007 | Chung et al. | 345/76 |
| 2007/0024543 | A1* | 2/2007 | Chung et al. | 345/76 |
| 2007/0024544 | A1* | 2/2007 | Chung et al. | 345/76 |
| 2007/0035487 | A1* | 2/2007 | Ryu et al. | 345/76 |
| 2007/0085781 | A1* | 4/2007 | Chung et al. | 345/76 |
| 2008/0001854 | A1 | 1/2008 | Hamer et al. | |
| 2008/0036703 | A1* | 2/2008 | Wang et al. | 345/76 |
| 2008/0122759 | A1 | 5/2008 | Levey | |
| 2008/0180365 | A1 | 7/2008 | Ozaki | |
| 2008/0224962 | A1 | 9/2008 | Kasai et al. | |
| 2008/0231562 | A1* | 9/2008 | Kwon | 345/77 |
| 2008/0252568 | A1* | 10/2008 | Kwon | 345/76 |
| 2008/0252569 | A1* | 10/2008 | Kwon | 345/76 |
| 2008/0252570 | A1* | 10/2008 | Kwon | 345/76 |
| 2009/0027376 | A1* | 1/2009 | Kwon | 345/214 |
| 2009/0027377 | A1* | 1/2009 | Kwon | 345/214 |
| 2009/0027423 | A1* | 1/2009 | Kwon | 345/690 |
| 2009/0184901 | A1* | 7/2009 | Kwon | 345/77 |
| 2009/0184903 | A1* | 7/2009 | Kwon | 345/80 |
| 2009/0309818 | A1* | 12/2009 | Kim | 345/77 |
| 2011/0007067 | A1* | 1/2011 | Ryu et al. | 345/214 |

FOREIGN PATENT DOCUMENTS

| | | | |
|---|---|---|---|
| EP | 1 758 084 | A2 | 2/2007 |
| JP | 11-219146 | | 8/1999 |
| JP | 2002-278514 | | 9/2002 |
| JP | 2003-22049 | | 1/2003 |
| JP | 2003-058106 | | 2/2003 |
| JP | 2003-195813 | | 7/2003 |
| JP | 2004-004673 | | 1/2004 |
| JP | 2004-004675 | | 1/2004 |
| JP | 2004-101767 | | 4/2004 |
| JP | 2004-145257 | | 5/2004 |
| JP | 2005-043888 | | 2/2005 |
| JP | 2005-115144 | | 4/2005 |
| JP | 2005-128272 | | 5/2005 |
| JP | 2005-258427 | | 9/2005 |
| JP | 2005-308775 | | 11/2005 |
| JP | 2005-309230 | | 11/2005 |
| JP | 2006-058352 | | 3/2006 |
| JP | 2006-126874 | | 5/2006 |
| JP | 2007-052202 | | 3/2007 |
| JP | 2007-140325 | | 6/2007 |
| JP | 2007-206139 | | 8/2007 |
| KR | 2001-0080746 | | 8/2001 |
| KR | 2003-0081080 | | 10/2003 |
| KR | 2003-0094721 | | 12/2003 |
| KR | 10-2004-0092617 | | 11/2004 |
| KR | 10-2005-0049320 | | 5/2005 |
| KR | 10-2005-0052332 | | 6/2005 |
| KR | 10-2006-0029062 | | 4/2006 |
| KR | 10-2006-0112993 | | 11/2006 |
| KR | 10-2006-0112995 | | 11/2006 |
| KR | 10-2006-0132795 | | 12/2006 |
| KR | 10-2007-0000422 | | 1/2007 |
| KR | 10-2007-0015826 | | 2/2007 |
| KR | 10-2007-0019882 | | 2/2007 |
| WO | WO 98/40871 | | 9/1998 |
| WO | WO 2005/015530 | A1 | 2/2005 |
| WO | WO 2005/109389 | A1 | 11/2005 |
| WO | WO 2006/063448 | A1 | 6/2006 |
| WO | WO 2007/036837 | A2 | 4/2007 |
| WO | WO 2007/037269 | A1 | 4/2007 |
| WO | WO 2007/090287 | A1 | 8/2007 |

OTHER PUBLICATIONS

Korean Patent Abstracts, Publication No. 1020030094721 A; Date of Publication: Dec. 18, 2003; in the name of Jun Gyu Park.

Korean Patent Abstracts, Publication No. 1020070015826 A; Date of Publication: Feb. 6, 2007; in the name of Bo Yong Chung, et al.

Japanese Office action dated Nov. 16, 2010, for corresponding Japanese Patent application 2007-306366, noting listed references in this IDS.

European Patent Office Action dated May 11, 2011, in corresponding European patent Application No. 08162287.0, 7 pages.

KIPO Office action dated Aug. 29, 2008, for Korean Patent application 10-2007-0028166, 2 pages.

KIPO Notice ofAllowance dated Jun. 26, 2008, for Korean Patent application 10-2007-0035009, 2 pages.

KIPO Office action dated Aug. 29, 2008, for Korean Patent application 10-2007-0035011, 2 pages.

KIPO Notice of Allowance dated Jun. 26, 2008, for Korean Patent application 102007-0035012, 2 pages.

Japanese Office action dated Jan. 4, 2011, for Japanese Patent application 2008-068098.

European Search Report dated Apr. 8, 2011, for European Patent application 09150727.7.

U.S. Office action dated Mar. 8, 2011, for cross-reference U.S. Appl. No. 12/077,828.

U.S. Office action dated Mar. 3, 2011, for cross-reference U.S. Appl. No. 12/082,147.

U.S. Office action dated Mar. 15, 2011, for cross-reference U.S. Appl. No. 12/080,956.

U.S. Office action dated Aug. 4, 2011, for cross-reference U.S. Appl. No. 12/082,147.

KIPO Office action dated Mar. 23, 2009, for Korean Patent application 10-2008-0005615, priority to cross reference U.S. Appl. No. 12/354,214, 3 pages.

KIPO Office action dated May 28, 2009, for Korean Patent application 10-2008-0005615, priority to cross reference U.S. Appl. No. 12/354,214, 1 page.

Japanese Office action dated Oct. 4, 2011, for corresponding Japanese Patent application 2007-306366, 2 pages.

European Search Report dated May 7, 2010, for European Patent application 09150727.7, 7 pages.

U.S. Office action dated Sep. 28, 2011, for cross-reference U.S. Appl. No. 12/354,214, 14 pages.

Japanese Office action dated Feb. 28, 2012, for corresponding Japanese Patent application 2007-306366, 3 pages.

European Search report dated Aug. 22, 2012, for corresponding European Patent application 08162287.0, (11 pages).

* cited by examiner

ORGANIC LIGHT EMITTING DISPLAY AND DRIVING METHOD THEREOF

CROSS-REFERENCE TO RELATED APPLICATIONS

This application claims priority to and the benefit of Korean Patent Application No. 10-2007-0084730, filed on Aug. 23, 2007, in the Korean Intellectual Property Office, the entire content of which is incorporated herein by reference.

BACKGROUND

1. Field of the Invention

The present invention relates to an organic light emitting display and a driving method thereof, and in particular to an organic light emitting display and a driving method thereof capable of displaying an image with substantially uniform luminance.

2. Discussion of Related Art

Recently, various flat panel display devices having reduced weight and volume, which are disadvantages of cathode ray tubes, have been developed. Types of flat panel display devices include a liquid crystal display (LCD), a field emission display (FED), a plasma display panel (PDP) and an organic light emitting display, etc.

An organic light emitting display among the flat panel display devices displays an image using organic light emitting diodes (OLEDs) that generate light using the recombination of electrons and holes. Such organic light emitting display has advantages that it has a high response speed and is driven with low power consumption.

FIG. 1 is a circuit diagram showing a pixel of an organic light emitting display. Referring to FIG. 1, the pixel 4 of the organic light emitting display includes a pixel circuit 2 coupled to an organic light emitting diode OLED, a data line Dm, and a scan line Sn to control the organic light emitting diode OLED.

An anode electrode of the organic light emitting diode OLED is coupled to the pixel circuit 2 and a cathode electrode of the organic light emitting diode OLED is coupled to a second power supply ELVSS. The organic light emitting diode OLED is light emitted at luminance corresponding to current supplied from the pixel circuit 2.

The pixel circuit 2 controls the amount of current supplied to the organic light emitting diode OLED corresponding to a data signal supplied to the data line Dm when a scan signal is supplied to the scan line Sn.

To this end, the pixel circuit 2 includes a second transistor M2 coupled between a first power supply ELVDD and the organic light emitting diode OLED; a first transistor M1 coupled between the second transistor M2, the data line Dm, and the scan line Sn; and a storage capacitor Cst coupled between a first electrode and a gate electrode of the second transistor M2.

A gate electrode of the first transistor M1 is coupled to the scan line Sn and a first electrode of the first transistor M1 is coupled to the data line Dm. A second electrode of the first transistor M1 is coupled to one terminal of the storage capacitor Cst.

Herein, the first electrode is one of a source electrode and a drain electrode and the second electrode is the other one of the source electrode and the drain electrode. For example, if the first electrode is the source electrode, the second electrode is the drain electrode. The first transistor M1 coupled to the scan line Sn and the data line Dm is turned on when the scan signal is supplied from the scan line Sn to supply the data signal supplied from the data line Dm to the storage capacitor Cst. At this time, the storage capacitor Cst charges voltages corresponding to the data signal.

The gate electrode of the second transistor M2 is coupled to one terminal of the storage capacitor Cst and the first electrode of the second transistor M2 is coupled to the other terminal of the storage capacitor Cst and the first power supply ELVDD. The second electrode of the second transistor M2 is coupled to the anode electrode of the organic light emitting diode OLED.

The second transistor M2 controls the amount of current flowing from the first power supply ELVDD to the second power supply ELVSS via the organic light emitting diode OLED, where the amount of current corresponds to a voltage value stored in the storage capacitor Cst. At this time, the organic light emitting diode OLED generates light corresponding to the amount of current supplied from the second transistor M2.

However, there is a problem that such an organic light emitting display cannot display an image with desired luminance due to the efficiency change according to the degradation of the organic light emitting diode OLED.

In practice, the organic light emitting diode OLED is degraded as time elapses so that light with gradually reduced luminance is generated. Also, the conventional organic light emitting display has a problem in that the image with uniform luminance is not displayed due to the non-uniformity of the threshold voltage/mobility of the driving transistor M2 included in the pixels 4.

SUMMARY OF THE INVENTION

It is an aspect according to an exemplary embodiment of the present invention to provide an organic light emitting display and a driving method thereof capable of displaying an image with substantially uniform luminance irrespective of degradation of organic light emitting diodes and threshold voltage/mobility of driving transistors.

An organic light emitting display according to an exemplary embodiment of the present invention includes: a plurality of pixels at crossing portions of data lines, scan lines, and emission control lines; each of the plurality of pixels including an organic light emitting diode for emitting light and a driving transistor for driving the organic light emitting diode; a sensor for sensing degradation information of the organic light emitting diodes and mobility information of the driving transistors; a converter for storing the degradation information of the organic light emitting diodes and the mobility information of the driving transistors and for converting input data to corrected data by utilizing the degradation information and the mobility information; and a data driver for receiving the corrected data output from the converter and for generating data signals utilizing the corrected data to be supplied to the plurality of pixels via the data lines.

A driving method of an organic light emitting display according to an embodiment of the present invention includes: generating a first voltage while supplying a first current to organic light emitting diodes included in a plurality of pixels; converting the first voltage to a first digital value and storing the first digital value in a memory; generating a second voltage while sinking a second current via driving transistors in the plurality of pixels; generating a third voltage while sinking a third current via the driving transistors in the plurality of pixels; converting information corresponding to a difference between the second voltage and the third voltage to a second digital value and storing the second digital value in the memory; converting input data to corrected data to display an image with substantially uniform luminance utilizing the first and second digital values stored in the memory irrespective of the degradation of the organic light emitting diodes and the mobility of the driving transistors; and providing data signals corresponding to the corrected data to data lines.

A driving method of an organic light emitting display according to another embodiment of the present invention includes: measuring voltage change across organic light emitting diodes in a plurality of pixels by utilizing a first current and storing the voltage change; sequentially sinking a second current and a third current via driving transistors in the plurality of pixels to measure a second voltage corresponding to the second current and a third voltage corresponding to the third current and to store a difference between the second voltage and the third voltage; converting input data to corrected data utilizing the voltage change and the different between the second and third voltages to compensate for the degradation of the organic light emitting diodes and a variance in mobility among the driving transistors; and applying data signals corresponding to the corrected data to the plurality of pixels during a display period and compensating for threshold voltages of the driving transistors in respective pixel circuits of the plurality of pixels through an initialization process.

BRIEF DESCRIPTION OF THE DRAWINGS

These and/or other embodiments and features of the invention will become apparent and more readily appreciated from the following description of certain exemplary embodiments, taken in conjunction with the accompanying drawings of which.

DETAILED DESCRIPTION

Figure 1:
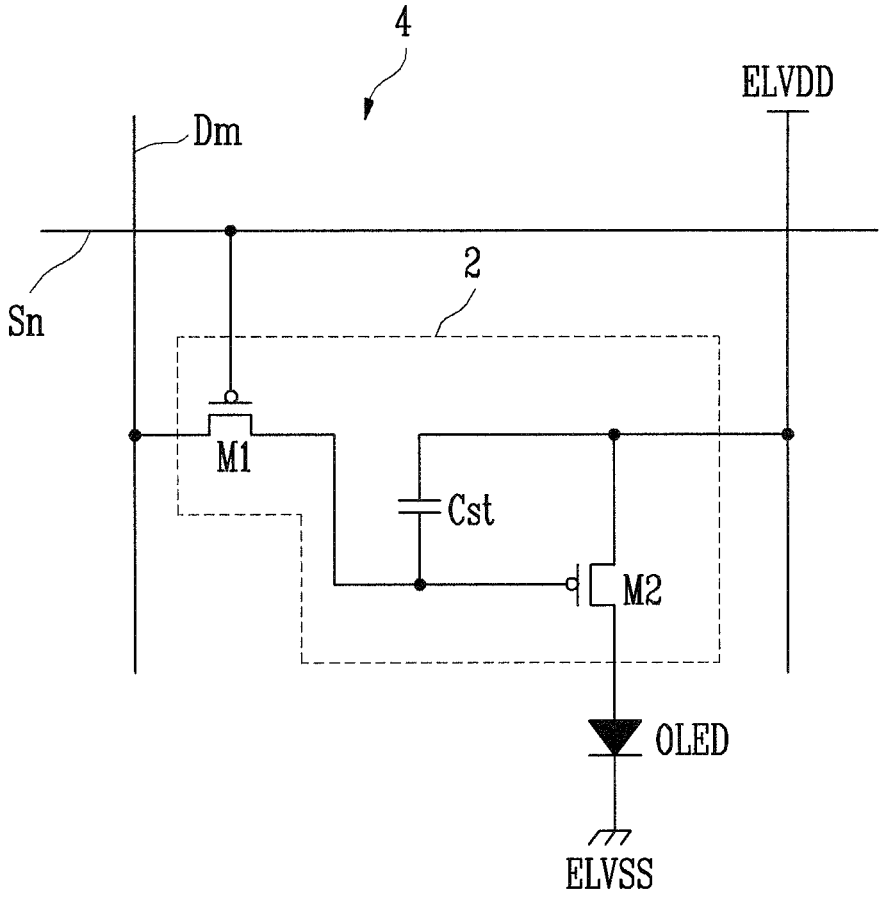
FIG. 1 (PRIOR ART)
FIG. 1 is a circuit diagram showing a pixel.

Hereinafter, certain exemplary embodiments according to the present invention will be described with reference to the accompanying drawings. Here, when a first element is described as being coupled to a second element, the first element may be not only be directly coupled to the second element but may alternately be indirectly coupled to the second element via a third element. Further, some of the elements that are essential to the complete understanding of the invention are omitted for clarity. Also, like reference numerals refer to like elements throughout.

Hereinafter, exemplary embodiments according to the present invention will be described with reference to the accompanying drawings.

Figure 2:
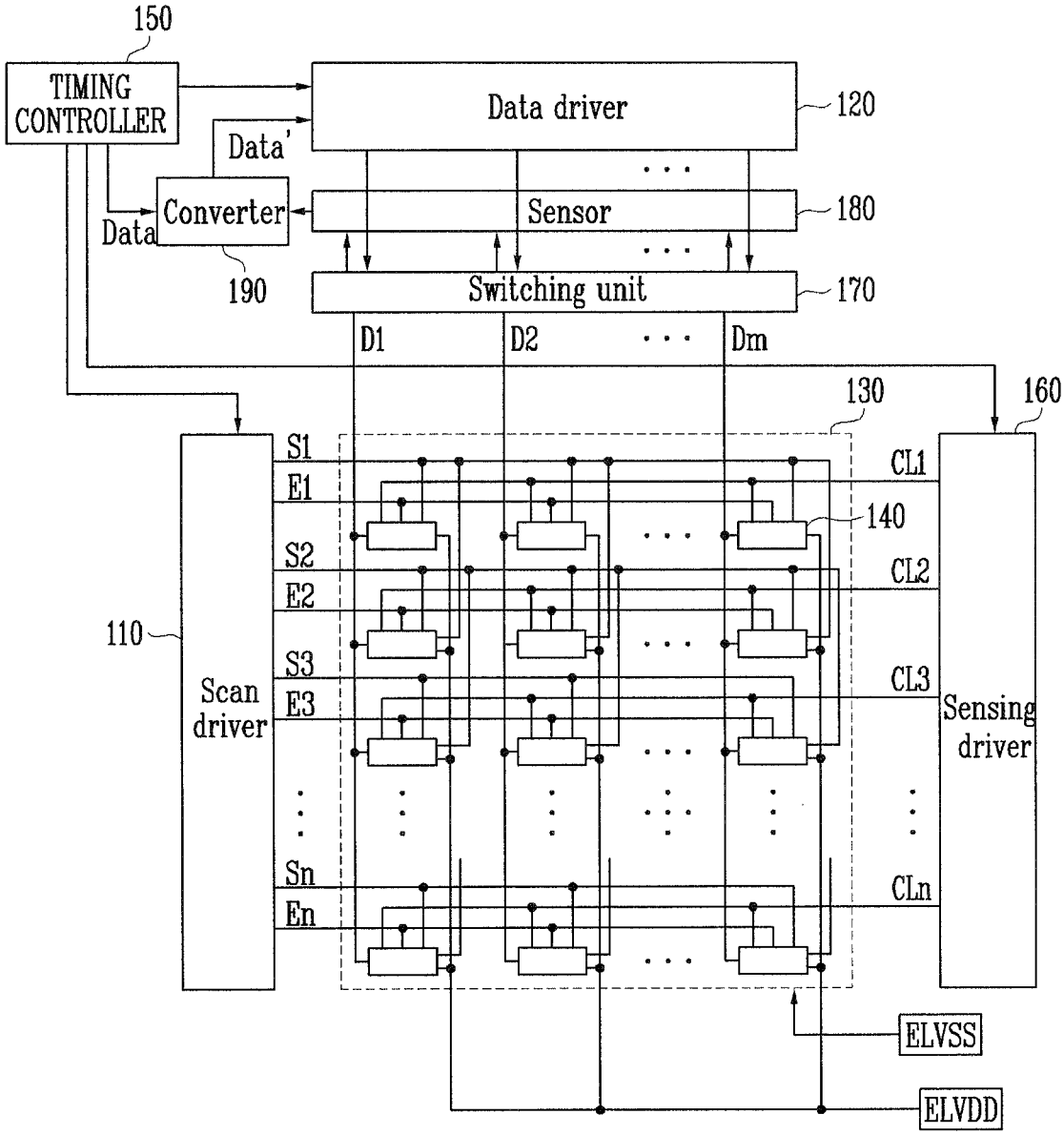
FIG. 2 is a schematic block diagram showing an organic light emitting display according to an embodiment of the present invention.

FIG. 2 is a schematic block diagram showing an organic light emitting display according to an embodiment of the present invention.

Referring to FIG. 2, the organic light emitting display according to an embodiment of the present invention includes: a display region 130 having pixels 140, which are coupled to scan lines S1 to Sn, emission control lines E1 to En, sensing lines CL1 to CLn, and data lines D1 to Dm; a scan driver 110 for driving the scan lines S1 to Sn and the emission control lines E1 to En; a sensing line driver ("sensing driver") 160 for driving the sensing lines CL1 to CLn; and a data driver 120 for driving the data lines D1 to Dm; and a timing controller 150 controlling the scan driver 110, the data driver 120, and the sensing line driver 160.

Also, the organic light emitting display according to the embodiment of the present invention further includes: a sensor 180 for extracting degradation information on organic light emitting diodes and mobility information on driving transistors, which are included in respective pixels 140; a switching unit 170 for selectively coupling the sensor 180 and the data driver 120 to the data lines D1 to Dm; and a converter 190 for storing the information sensed by using the sensor 180 and converting input data to display an image with substantially uniform luminance using the stored information irrespective of the degradation of the organic light emitting diodes and the mobility of the driving transistors.

The display region 130 includes the pixels 140 positioned at the crossing portions ("crossings") of the scan lines S1 to Sn, the emission control lines E1 to En, and the data lines D1 to Dm. The pixels 140 are supplied with a first power supply ELVDD and a second power supply ELVSS from an external power supply. The pixels 140 control the amount of current supplied from the first power supply ELVDD to the second power supply ELVSS via the respective organic light emitting diodes in accordance with the data signals. Then, light with corresponding luminance (e.g., predetermined luminance) is generated from the organic light emitting diodes.

The scan driver 110 supplies the scan signals to the scan lines S1 to Sn in accordance with the control of the timing controller 150. Also, the scan driver 110 supplies the emission control signals to the emission control lines E1 to En in accordance with the control of the timing controller 150.

The sensing line driver 160 supplies sensing signals to the sensing lines CL1 to CLn in accordance with the control of the timing controller 150.

The data driver 120 supplies the data signals to the data lines D1 to Dm in accordance with the control of the timing controller 150.

The switching unit 170 selectively couples the sensor 180 and the data driver 120 to the data lines D1 to Dm. To this end, the switching unit 170 includes a pair of switching elements coupled to the data lines D1 to Dm, respectively (that is, a pair of switching elements for each channel).

The sensor 180 extracts the degradation information of the organic light emitting diode included in each pixel 140 and supplies the extracted degradation information to the converter 190. Also, the sensor 180 extracts the mobility information on the driving transistors included in each pixel 140 and supplies the extracted mobility information to the converter 190. To this end, the sensor 180 includes sensing circuits couple to the data lines D1 to Dm, respectively (that is, a sensing circuit for each channel).

According to one exemplary embodiment, the extraction of the degradation information of the organic light emitting diode is performed in a first non-display period (or a first non-display time) prior to the display of image after the power supply is applied to the organic light emitting display. In other words, the extraction of the degradation information of the organic light emitting diode may be performed each time the power supply is applied to the organic light emitting display.

In the described embodiment, the extraction of the mobility information of the driving transistor is performed in a second non-display period (or a second non-display time) prior to the display of image after the power supply is applied to the organic light emitting display. Also, the extraction of the degradation information of the organic light emitting diode may be performed before the organic light emitting display is distributed as a product so that the mobility information may be provided as predefined information when distributing the product. In other words, according to one embodiment, the extraction of the mobility information of the driving transistor is performed each time the power supply is applied to the organic light emitting display. Alternatively, the performance results may be pre-stored before the product is distributed so that the pre-stored information may be used without performing the extraction of the mobility information each time the power supply is applied.

The converter 190 receives the degradation information and the mobility information supplied from the sensor 180, and stores the degradation information of the organic light emitting diodes and the mobility information of the driving transistors, which are respectively included in all the pixels. To this end, the converter 190 includes a memory and a conversion circuit for converting input data Data input from the timing controller to corrected data Data' to display an image with substantially uniform luminance using the information stored in the memory irrespective of the degradation of the organic light emitting diodes and the mobility of the driving transistors.

The timing controller 150 controls the data driver 120, the scan driver 110, and the sensing line driver 160.

Further, the data Data input from an external data source is converted to the corrected data Data' using the output from the timing controller 150 to compensate for the degradation of the organic light emitting diodes and the displacement in the mobility of the driving transistors using the converter 190, and is supplied to the data driver 120. Then, the data driver 120 uses the converted corrected data Data' to generate the data signals and supplies the generated data signals to the pixels 140.

In one embodiment according to the present invention, the degradation of the organic light emitting diodes and the mobility of the driving transistors are compensated using the sensor 180 and the converter 190 and the difference between the threshold voltages of the driving transistors is self-compensated within the pixel structure as will be described below.

Figure 3:
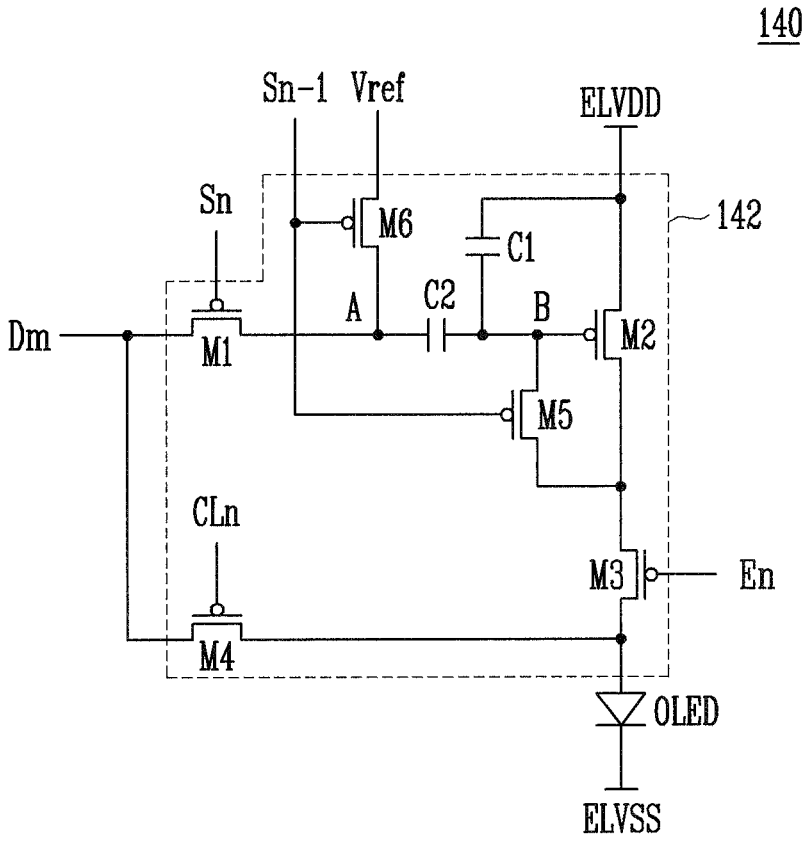
FIG. 3 is a circuit diagram showing a first embodiment of a pixel shown in FIG. 2.

FIG. 3 shows a first embodiment of a pixel shown in FIG. 2. For convenience of description, FIG. 3 shows a pixel coupled to an $m^{th}$ data line (Dm) and an $n^{th}$ scan line (Sn).

Referring to FIG. 3, the pixel 140 according to the first embodiment of the present invention includes an organic light emitting diode OLED and a pixel circuit 142 for supplying current to the organic light emitting diodes OLED.

The anode electrode of the organic light emitting diode OLED is coupled to the pixel circuit 142 and the cathode electrode of the organic light emitting diode OLED is coupled to the second power supply ELVSS. The organic light emitting diodes OLEDs generates light corresponding to current supplied from the pixel circuit 142.

The pixel circuit 142 is supplied with the data signal supplied to the data line Dm when the scan signal is supplied to the scan line Sn. Also, the pixel circuit 142 provides the degradation information of the organic light emitting diodes OLEDs and/or the mobility information of the driving transistor (that is, second transistor M2) to the sensor 180 when the sensing signal is supplied to the sensing line CLn. To this end, the pixel circuit 142 includes six transistors M1 to M6 and two capacitors C1 and C2.

The gate electrode of the first transistor M1 is coupled to the scan line Sn and the first electrode the first transistor M1 is coupled to the data line Dm. The second electrode of the first transistor M1 is coupled to a first node A.

The gate electrode of the second transistor M2 is coupled to a second node B and the first electrode of the second transistor M2 is coupled to the first power supply ELVDD.

Also, the first capacitor C1 is coupled between the first power supply ELVDD and the second node B and the second capacitor C2 is coupled between the first node A and the second node B.

The second transistor M2 controls the amount of current flowing from the first power supply ELVDD to the second power supply ELVSS via the organic light emitting diode OLED in accordance with the voltage values stored in the first and second capacitors C1 and C2. At this time, the organic light emitting diode OLED generates light corresponding to the amount of current supplied from the second transistor M2.

The gate electrode of the third transistor M3 is coupled to the emission control line En and the first electrode of the third transistor M3 is coupled to the second electrode of the second transistor M2. The second electrode of the third transistor M3 is coupled to the organic light emitting diode OLED. The third transistor M3 is turned off when the emission control signal is supplied to the emission control line En (high level) and is turned on when the emission control signal is not supplied to the emission control line En (low level). Here, the emission control signal is supplied (high level) during a period (Programming period) where the voltages corresponding to the data signals are charged in the first and second capacitors C1 and C2, a period (Vth storing period) in which the threshold voltage is stored, and a period (OLED degradation sensing period) in which the degradation information on the organic light emitting diode OLED is sensed.

The gate electrode of the fourth transistor M4 is coupled to the sensing line CLn and the first electrode of the fourth transistor M4 is coupled to the second electrode of the third transistor M3. Also, the second electrode of the fourth transistor M4 is coupled to the data line Dm. The fourth transistor M4 is turned on when the sensing signal is supplied to the sensing line CLn and is turned off in other cases. Here, the sensing signal is supplied during a period (OLED degradation sensing period) in which the degradation information of the organic light emitting diode OLED is sensed and a period in which the mobility information of the second transistor M2 ("driving transistor") is sensed.

The gate electrode of the fifth transistor M5 is coupled to the scan line Sn-1 of a previous row of pixels ("a previous scan line") and the first electrode of the fifth transistor M5 is coupled to the gate electrode of the second transistor M2. Also, the second electrode of the fifth transistor M5 is coupled to the second electrode of the second transistor M2. In other words, when the fifth transistor M5 is turned on, the second transistor M2 is diode-connected.

The gate electrode of the sixth transistor M6 is coupled to the scan line Sn-1 of the previous row of pixels ("the previous scan line"), the first electrode of the sixth transistor M6 is coupled to a reference voltage (Vref), and the second electrode of the sixth transistor M6 is coupled to the first node A.

In other words, when the sixth transistor M6 is turned on, the first electrode of the second capacitor C2 is supplied with the reference voltage Vref.

According to the embodiment of FIG. 3, the first to sixth transistors M1 to M6 are PMOS transistors, but the present invention is not limited thereto. For example, the first to sixth transistors M1 to M6 may be implemented as NMOS transistors in other embodiments.

Figure 4:
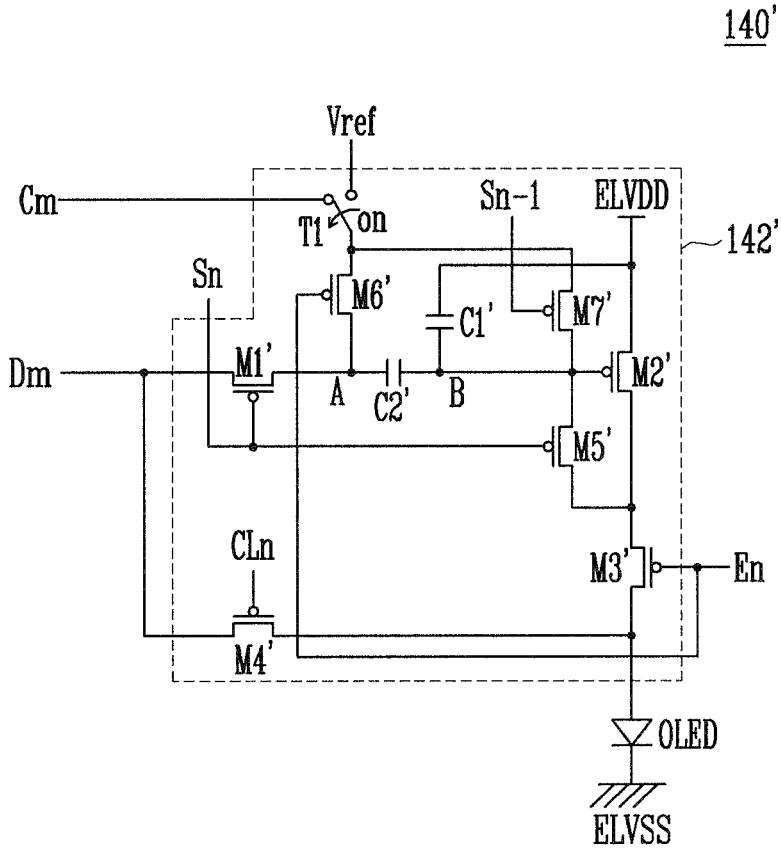
FIG. 4 is a circuit diagram showing a second embodiment of a pixel shown in FIG. 2.

FIG. 4 shows a second embodiment of a pixel shown in FIG. 2. For convenience of description, FIG. 4 shows a pixel coupled to an $m^{th}$ data line (Dm) and an $n^{th}$ scan line (Sn).

Referring to FIG. 4, the pixel 140' according to the second embodiment of the present invention includes an organic light emitting diode OLED and a pixel circuit 142' for supplying current to the organic light emitting diodes OLED. The pixel 140' according to the second embodiment is different from the pixel 140 according to the first embodiment shown in FIG. 3 in that the pixel circuit 142' includes seven transistors M1' to M7', two capacitors C1' and C2', and one switching element T1.

In the pixel circuit 142', the gate electrode of the first transistor M1' is coupled to the scan line Sn and the first electrode of the first transistor M1' is coupled to the data line Dm. The second electrode of the first transistor M1' is coupled to a first node A.

The gate electrode of the second transistor M2' is coupled to a second node B and the first electrode of the second transistor M2' is coupled to the first power supply ELVDD.

Also, the first capacitor C1' is coupled between the first power supply ELVDD and the second node B and the second capacitor C2' is coupled between the first node A and the second node B.

The second transistor M2' controls the amount of current flowing from the first power supply ELVDD to the second power supply ELVSS via the organic light emitting diode OLED in accordance with the voltage values stored in the first and second capacitors C1' and C2'. At this time, the organic light emitting diode OLED generates light corresponding to the amount of current supplied from the second transistor M2'.

The gate electrode of the third transistor M3' is coupled to the emission control line En and the first electrode of the third transistor M3' is coupled to the second electrode of the second transistor M2'. The second electrode of the third transistor M3' is coupled to the organic light emitting diode OLED. The third transistor M3' is turned off when the emission control signal is supplied to the emission control line En (high level) and is turned on when the emission control signal is not supplied to the emission control line En (low level). Here, the emission control signal is supplied (high level) during a period (OLED degradation sensing period) in which the degradation information on the organic light emitting diode OLED is sensed, a period (mobility sensing period) in which the mobility information of the second transistor M2' is sensed, an initialization period, a period in which the threshold voltage is stored, and a period (Vth storing and Programming period) in which the voltages corresponding to the data signals are charged.

The gate electrode of the fourth transistor M4' is coupled to the sensing line CLn and the first electrode of the fourth transistor M4' is coupled to the second electrode of the third transistor M3'. Also, the second electrode of the fourth transistor M4' is coupled to the data line Dm. Such a fourth transistor M4' is turned on when the sensing signal is supplied to the sensing line CLn and is turned off in other cases. Herein, the sensing signal is supplied during a period a period (OLED degradation sensing period) in which the degradation information of the organic light emitting diode OLED is sensed The gate electrode of the fifth transistor M5' is coupled to the scan line Sn and the first electrode of the fifth transistor M5' is coupled to the gate electrode of the second transistor M2'. Also, the second electrode of the fifth transistor M5' is coupled to the second electrode of the second transistor M2'. In other words, when the fifth transistor M5' is turned on, the second transistor M2' is diode-connected.

The gate electrode of the sixth transistor M6' is coupled to the emission control signal En, the first electrode of the sixth transistor M6' is coupled to the switching element T1 ("switch"), and the second electrode of the sixth transistor M6' is coupled to the first node A.

Also, the switching element T1 is coupled to the sensor 180 when it is turned on and to the reference voltage (Vref) source when it is turned off. In other words, when the switching element T1 is turned on, the pixel 140' is coupled to the sensor 180 via a separate control line Cm which is different from the data line Dm, and when the switching element T1 is turned off, the pixel 140' receives the reference voltage Vref.

In other words, the pixel 140' is coupled to the sensor 180 via the control line Cm in a period in which the mobility information of the second transistor M2' as the driving transistor is sensed.

The seventh transistor M7' is coupled to the scan line Sn-1 of a previous row of pixels ("previous scan line"), the first electrode of the seventh transistor M7' is coupled to the first electrode of the sixth transistor M6', and the second electrode of the seventh transistor M7' is coupled to the gate electrode of the second transistor M2'.

According to the embodiment of FIG. 4, the first to seventh transistors M1' to M7' are PMOS transistors, but the present invention is not limited thereto. For example, the first to seventh transistors M1' to M7' may be implemented as NMOS transistors in other embodiments.

Figure 5:
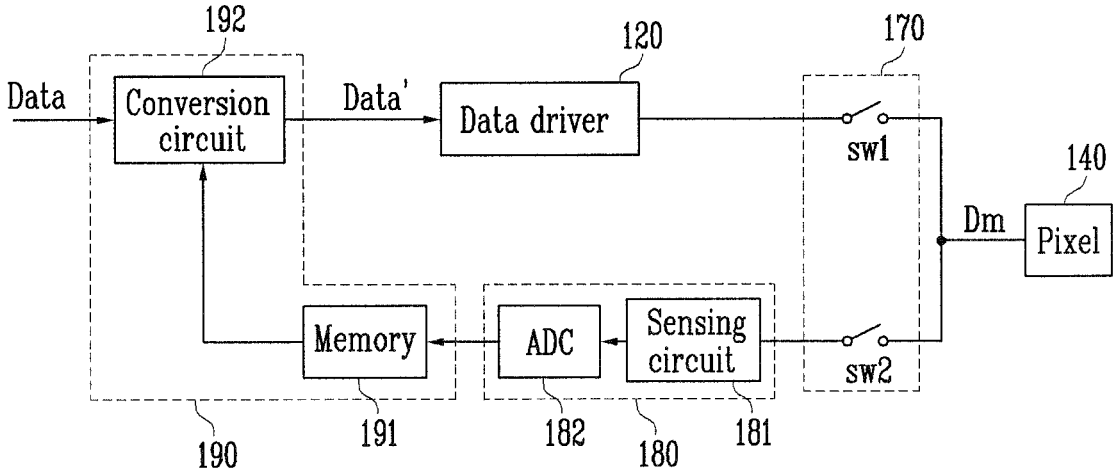
FIG. 5 is a block diagram showing a switching unit, a sensor, and a converter shown in FIG. 2.

FIG. 5 is a block diagram showing a switching unit, a sensor, and a converter shown in FIG. 2. However, FIG. 5 shows that these devices are coupled to only the pixel 140 coupled to the $m^{th}$ data line Dm for convenience of description.

Referring to FIG. 5, each channel in the switching unit 170 is provided with a pair of switches SW1 and SW2. Also, each channel in the sensor 180 is provided with a sensing circuit 181 and an analog-digital converter 182 (hereinafter, referred to as "ADC"). (Here, one ADC may be provided per one or a number of channels or all the channels may share one ADC). Also, the converter 190 includes a memory 191 and a conversion circuit 192.

The first switch SW1 of the switching unit 170 is positioned between the data driver 120 and the data line Dm. The first switch SW1 is turned on when the data signals are supplied via the data driver 120. In other words, the first switch SW1 maintains the turn-on state during a period in which the organic light emitting display device displays an image (e.g., a predetermined image).

Further, the second switch SW2 of the switching unit 170 is positioned between the sensor 180 and the data line Dm. The second switch SW2 is turned on during a period in which the mobility information of the second transistor M2 and the degradation information of the organic light emitting diodes OLEDs provided from respective pixels of the display region are sensed by the sensor 180.

Here, the second switch SW2 maintains the turn-on state during a non-display period (or a non-display time) from after the power supply is applied to the organic light emitting display to before the image is displayed, or maintains the turn-on state during a non-display period (or a non-display time) before the product is distributed.

In more detail, according to one exemplary embodiment, the sensing of the degradation information of the organic light emitting diode OLED is performed in the non-display period from after the power supply is applied to the organic light emitting display to before the image is displayed. In other words, the sensing of the degradation information of the organic light emitting diode OLED in this embodiment is performed each time the power supply is applied to the organic light emitting display.

According to another exemplary embodiment, the sensing of the mobility information of the driving transistor is performed in the second non-display period from after the power supply is applied to the organic light emitting display to before the image is displayed as well as may be performed before the organic light emitting display is first distributed as a product.

In other words, the sensing of the mobility information of the driving transistor may be performed each time the power supply is applied to the organic light emitting display, or may use the pre-stored information without performing the extraction of the mobility information each time the power supply is applied by previously storing the performance results before the product is distributed.

Figure 6:
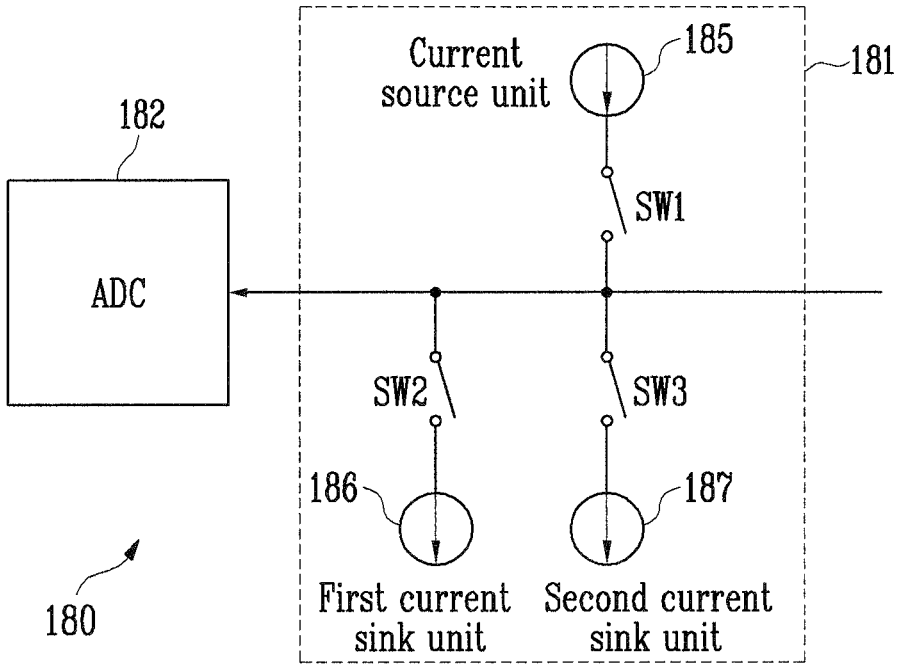
FIG. 6 is a schematic block diagram showing sensing circuits shown in FIG. 5.

The sensing circuit 181 includes a current source unit ("current source") 185, first and second current sink units ("current sinks") 186 and 187, and switching elements SW1, SW2, and SW3 each coupled to the corresponding one of the current source unit 185 and first and second current sink units 186 and 187, as shown in FIG. 6.

The current source unit 185 supplies a first current to the pixel 140 when the first switching element SW1 is turned on and supplies voltage (e.g., a predetermined voltage) generated in the data line Dm to the ADC 182 when the first current is supplied. Here, the first current is supplied via the organic light emitting diode OLED included in the pixel 140. Accordingly, the voltage (e.g., a first voltage or a first predetermined voltage) generated from the current source unit 185 has the degradation information of the organic light emitting diode OLED.

In more detail, as the organic light emitting diode OLED is degraded, the resistance value of organic light emitting diode OLED is changed. Therefore, the voltage value of the voltage is changed corresponding to the degradation of the organic light emitting diode OLED so that the degradation information of the organic light emitting diode OLED can be extracted.

On the other hand, the current value of the first current is variously set to be able to be applied with the predetermined voltage within defined time. For example, the first current may be set to a current value Imax that flows to the organic light emitting diode OLED when light is emitted from the pixel 140 at maximum luminance.

The first current sink unit 186 sinks a second current from the pixel 140 when the second switching element SW2 is turned on and measures a voltage (e.g., a second voltage or a second predetermined voltage) generated in the data line Dm or the control line Cm when the second current is sunk.

In other words, in the case where the pixel 140 of the first embodiment shown in FIG. 3 is applied, the second voltage generated in the data line Dm is measured and in the case where the pixel 140' of the second embodiment shown in FIG. 4 is applied, the second voltage generated in the control line Cm is measured.

Also, the second current sink unit 187 sinks a third current from the pixel 140 when the second switching element SW2 is turned off and the third switching element SW3 is turned on and predetermined voltage (third voltage) generated in the data line Dm or the control line Cm is measured when the third current is sunk.

In other words, in the case where the pixel 140 of the first embodiment shown in FIG. 3 is applied, the third voltage generated in the data line Dm is measured and in the case where the pixel 140' of the second embodiment shown in FIG. 4 is applied, the third voltage generated in the control line Cm is measured.

At this time, the information corresponding to the difference between the second voltage and the third voltage is supplied to the ADC 182.

Here, the second current and the third current are sunk via the second transistors M2 and M2' included in the pixels 140 and 140'. Therefore, the absolute value of the difference (|the second voltage−the third voltage|) between the voltages of the data line Dm or the control line Cm generated via the first and second current sink units 186 and 187 has the mobility information of the second transistors M2 and M2'.

In other words, in the case where the pixel 140' of the second embodiment shown in FIG. 4 is applied, the switching element T1 within the pixel 140' is turned on when the second current and the third current are sunk so that the anode electrode of the organic light emitting diode OLED is not included in the path to which the mobility information on the second transistor M2' is transferred.

Because of this, the mobility information of the second transistor M2' is not influenced by the degradation degree of the organic light emitting diode OLED so that the more accurate information can be obtained.

The ADC 182 converts the first voltage supplied from the sensing circuit 181 to a first digital value and converts the difference between the second voltage and the third voltage to a second digital value.

Further, the converter 190 includes the memory 191 and the conversion circuit 192. The memory 191 stores the first digital value and the second digital value supplied from the ADC 182. Actually, the memory 191 stores the mobility information of the second transistor M2 or M2' and the degradation information of the organic light emitting diodes OLEDs in respective pixels 140 or 140' included in the display region 130.

The conversion circuit 192 uses the first digital value and the second digital value stored in the memory 191 to convert the input data Data transferred from the timing controller 150 to the corrected data Data' so that the image with substantially uniform luminance can be displayed irrespective of the degradation of the organic light emitting diodes OLEDs and the mobility of the driving transistor M2 or M2'.

For example, the conversion circuit 192 generates the corrected data Data' by increasing bit values of the input data Data by referencing the first digital value as the organic light emitting diode OLED is degraded. The generated corrected data Data' is transferred to the data driver 120 and ultimately, the data signals in accordance with the corrected data Data' are supplied to the pixels 140 or 140'. As a result, as the organic light emitting diode is degraded, a generation of light with low luminance can be reduced or prevented.

Further, the conversion circuit 192 converts the input data Data in reference to the second digital value so that the mobility of the second transistors M2 or M2' can be compensated. As a result, the image with substantially uniform luminance can be displayed irrespective of the mobility of the second transistors M2 or M2'.

The data driver 120 uses the corrected data Data' to generate the data signals and supplies the generated data signals to the pixels 140 or 140'.

Figure 7:
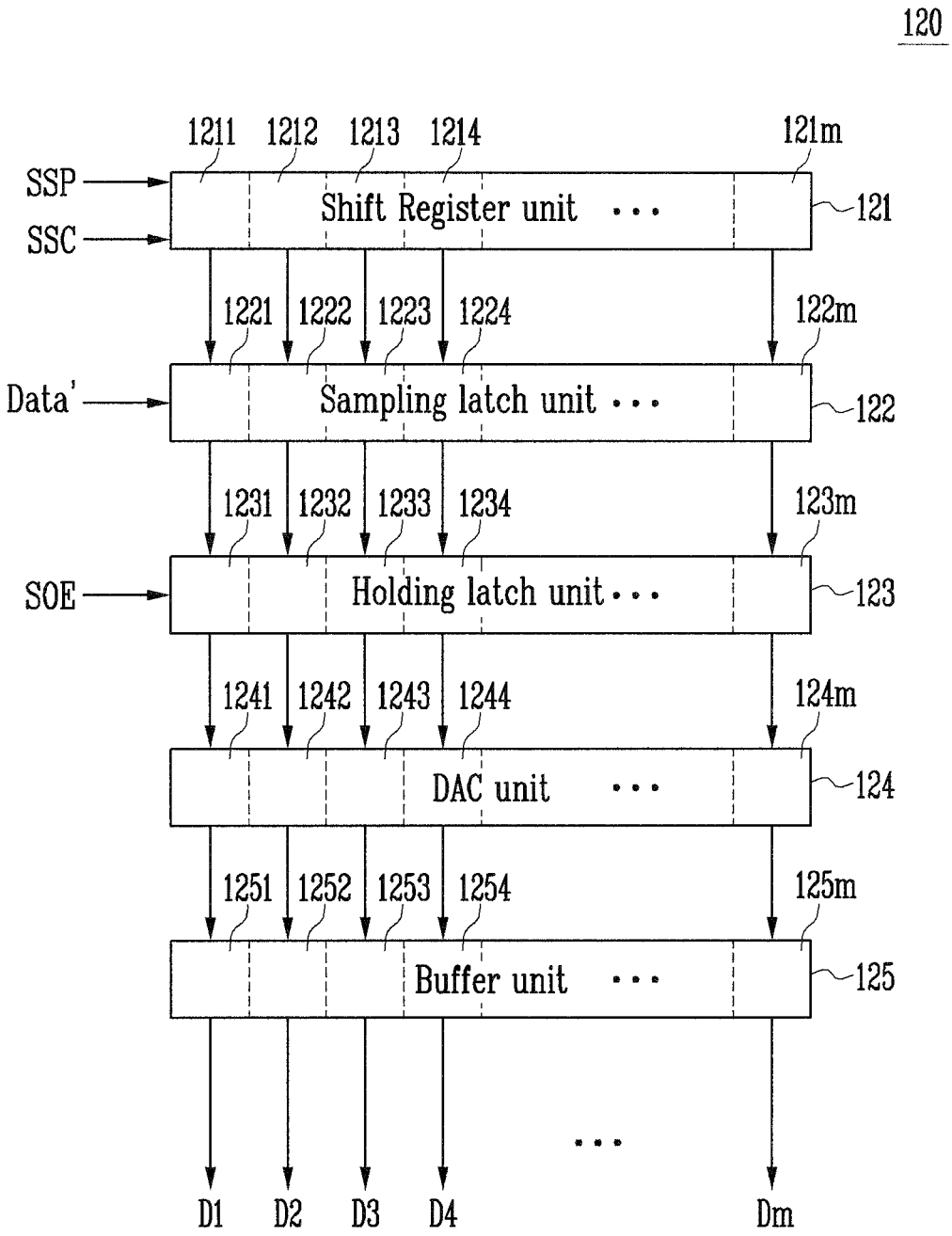
FIG. 7 is a schematic block diagram showing an embodiment of a data driver shown in FIG. 2.

FIG. 7 is a schematic block diagram showing an embodiment of a data driver 120.

Referring to FIG. 7, the data driver 120 includes a shift register unit 121, a sampling latch unit 122, a holding latch unit 123, a digital-analog converter (hereinafter, referred to as "DAC") 124, and a buffer unit 125.

The shift register unit 121 is supplied with a source start pulse SSP and a source shift clock SSC from the timing controller 150. The shift register unit 121 supplied with the source shift clock SSC and the source start pulse SSP shifts the source start pulse SSP per one period of the source shift clock SSC and at the same time, sequentially generates m sampling signals. To this end, the shift register 121 includes m shift registers 1211 to 121*m*.

The sampling latch unit 122 sequentially stores the corrected data Data' in response to the sampling signals sequentially supplied from the shift register unit 121. To this end, the sampling latch unit 122 includes m sampling latches 1221 to 122*m* for storing the m corrected data Data'.

The holding latch unit 123 is supplied with a source output enable (SOE) signal from the timing controller 150. The holding latch unit 123 supplied with the a source output enable (SOE) signal receives the corrected data Data' from the sampling latch unit 122 and stores them. And, the holding latch unit 123 supplies the corrected data Data' stored therein to the digital-analog converter unit (DAC unit) 124. To this end, the holding latch unit 123 includes m holding latches 1231 to 123*m*.

The DAC unit 124 receives the corrected data Data' from the holding latch unit 123 and generates the m data signals corresponding to the input corrected data Data'. To this end, the DAC unit 124 includes m digital-analog converters (DACs) 1241 to 124*m*. In other words, the DAC unit 124 uses the DACs 1241 to 124*m* positioned at respective channels to generate the m data signals and supplies the generated m data signals to the buffer unit 125.

The buffer unit 125 supplies the m data signals supplied from the DAC unit 124 to the m data lines D1 to Dm, respectively. To this end, the buffer unit 125 includes m buffers 1251 to 125*m*.

FIGS. 8A to 8G are schematic circuit diagrams for illustrating a driving method of an organic light emitting display according to the first embodiment of the present invention However, for convenience of description, FIGS. 8A to 8G will illustrate the first embodiment only in reference to the pixel 140 coupled to the $n^{th}$ scan line Sn and the $m^{th}$ data line Dm (shown in FIG. 3).

As described above, the sensing of the mobility information of the driving transistor may be performed each time the power supply is applied to the organic light emitting display or may be performed before the product is distributed so that the performance results are pre-stored. Using the second method, the pre-stored information for the mobility information of the driving transistor can be used without performing the extraction of the mobility information each time the power supply is applied.

FIGS. 8A to 8G illustrate the example in which the sensing of the mobility information of the driving transistor is performed each time the power supply is applied to the organic light emitting display. However, it should be apparent to those skilled in the art that the present invention is not limited thereto.

Hereinafter, the driving method of the organic light emitting display according to one embodiment of the present invention will be described in more detail with reference to FIGS. 8A to 8G.

Figure 8A:
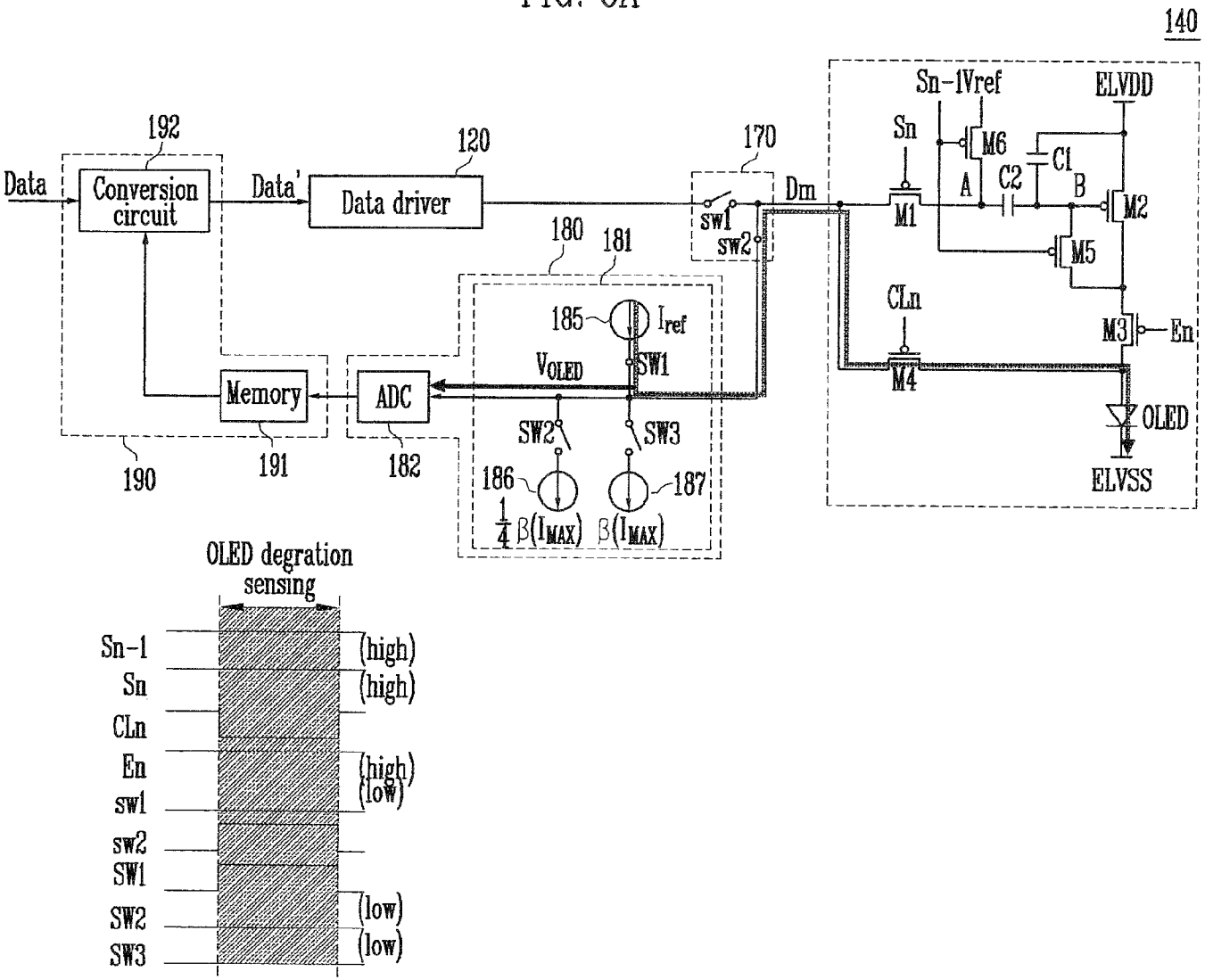
FIGS. 8A to 8G are schematic circuit diagrams for illustrating a driving method of an organic light emitting display according to a first embodiment of the present invention.

First, FIG. 8A illustrates an operation during a first non-display period from after the power supply is applied to the organic light emitting display to before the image is displayed.

The operation for sensing (OLED degradation sensing) the degradation information on the organic light emitting diode OLED is performed in the first non-display period.

As shown in FIG. 8A, in the first non-display period the scan signals Sn and Sn-1 are applied at a high level, the sensing signal CLn is applied at a low level, and the emission control signal En is applied at a high level so that only the fourth transistor M4 within the pixel circuit of the pixel 140 is turned on.

Also, in the switching unit 170 the first switch sw1 is turned off and the second switch sw2 is turned on so that the pixel 140 is coupled to the sensor 180.

Further, within the sensing circuit 181 the first switching element SW1 coupled to the current source unit 185 is turned on and the second and third switching elements SW2 and SW3 coupled to the first and second current sink units 186 and 187 are turned off. At this time, for example, the first current Iref supplied by the current source unit 185 can be set to the current value Imax that flows to the organic light emitting diode OLED when the pixel 140 is light-emitted at maximum luminance. The first current Iref supplied by the current source unit 185 according to the application of the signals as above is applied to the organic light emitting diode OLED via the data line Dm and the fourth transistor M4 within the pixel 140.

Therefore, the voltage (predetermined voltage or first voltage, $V_{OLED}$) applied to the anode electrode of the organic light emitting diode OLED is equally applied to the sensing circuit 181 and the first voltage $V_{OLED}$ is supplied to the ADC 182.

In other words, the first voltage $V_{OLED}$ generated through the current source unit 185 has the degradation information of the organic light emitting diode OLED.

The ADC 182 converts the first voltage $V_{OLED}$ supplied from the sensing circuit 181 to the first digital value and the memory 191 stores the first digital value supplied by the ADC 182. In practice, the memory 191 stores the degradation information of the respective organic light emitting diode OLEDs of all pixels 140 included in the display region 130.

Figure 8B:
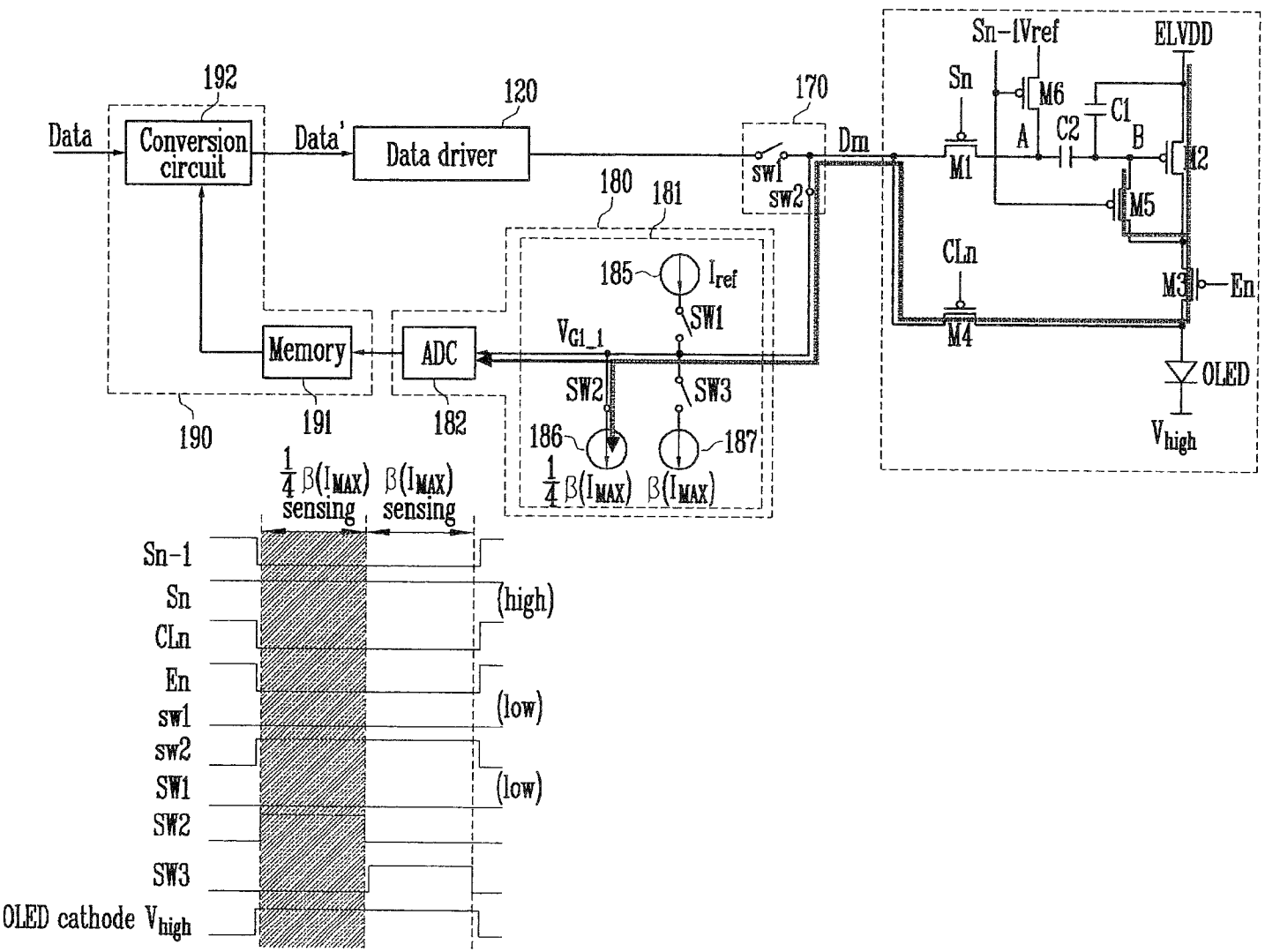
Figure 8C:
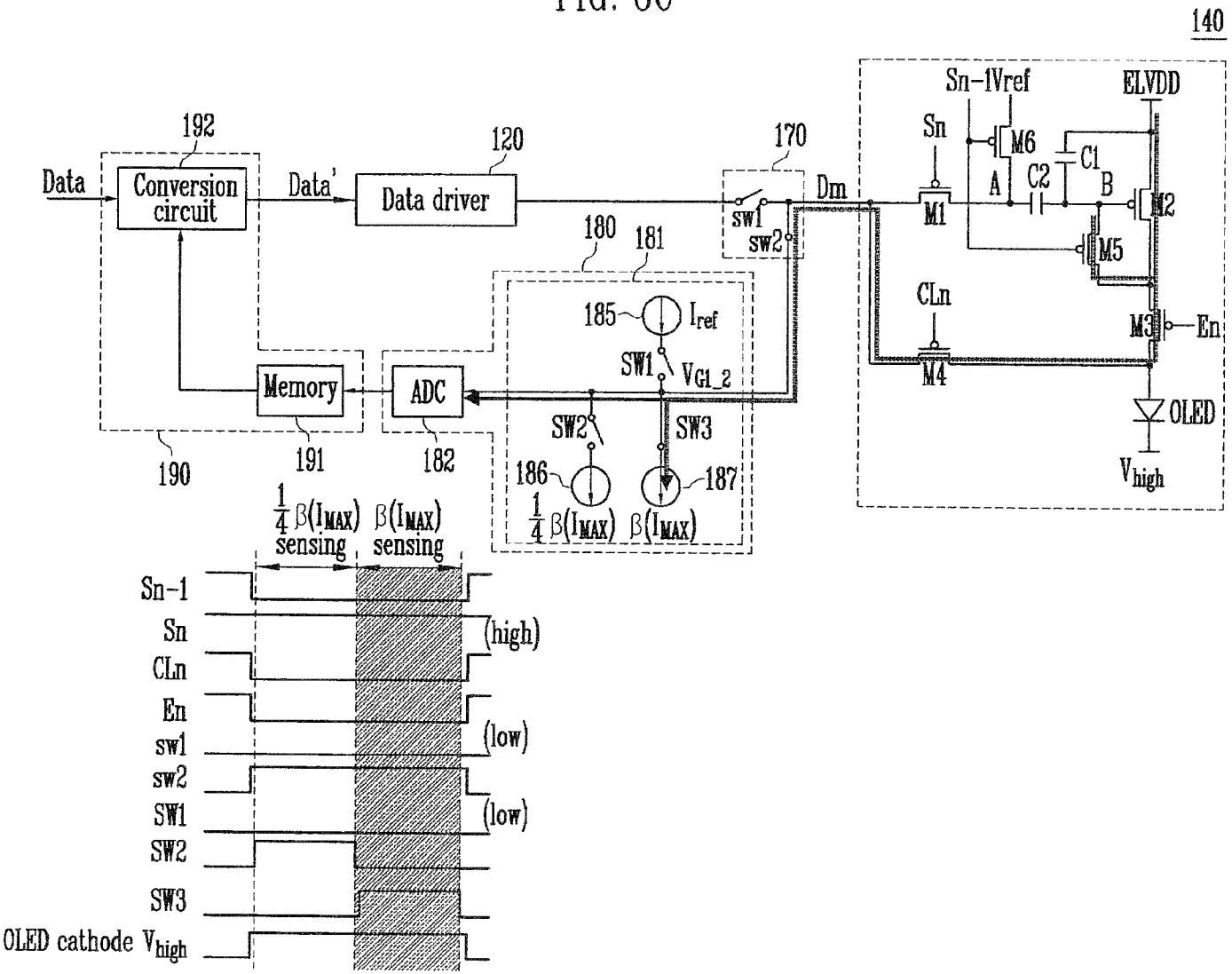

Next, FIGS. 8B and 8C illustrate an operation from after the first non-display period of FIG. 8A to a second non-display period prior to the display of image.

The sensing operation of the mobility information of the second transistor M2 as the driving transistor within the pixel 140 is performed in the second non-display period.

In the described embodiment of the present invention, in order to sense the mobility information of the second transistor M2, the second non-display period is divided into two periods so that the operations for sinking currents are performed independently.

In other embodiments, as described above, the sensing of the mobility information of the second transistor M2 may be performed before the product is distributed so that the performance results are pre-stored. This way, the pre-stored information of the mobility information of the driving transistor can be used without performing the extraction of the mobility information each time the power supply is applied.

As shown in FIG. 8B, in a first period of the second non-display period, the previous scan signal Sn-1 of a previous row of pixels is applied at a low level, the scan signal Sn is applied at a high level, the sensing signal CLn is applied at a low level, and the emission control signal En is applied at a high level so that the third transistor M3, the fourth transistor M4, and the fifth transistor M5 within the pixel circuit of the pixel 140 are turned on. Also, because the fifth transistor M5 is turned on, the second transistor M2 is diode-connected and turned on.

Further, because the previous scan signal Sn-1 is applied at a low level, the sixth transistor M6 is turned on. As a result, the reference voltage Vref applied to the first electrode of the sixth transistor M6 is applied to the first node A.

Also, in the switching unit 170 the first switch sw1 is turned off and the second switch sw2 is turned on so that the pixel 140 is coupled to the sensor 180.

Further, within the sensing circuit 181 the first switching element SW1 coupled to the current source unit 185 is turned off, the second switching unit SW2 coupled to the first current sink unit 186 is turned on and the third switching unit SW3 coupled to the second current sink unit 187 is turned off. At this time, the second current sunk in the first current sink unit 186 may be (¼)βImax as an example as shown (β is a constant) in FIG. 8B.

Also, the cathode electrode of the organic light emitting diode OLED is applied with a high-level voltage rather than the second voltage ELVSS. This is to prevent the current sunk in the first current sink unit 186 from being supplied to the organic light emitting diode (OLED).

The first current sink unit 186 sinks the second current, that is, (¼)βImax from the first power supply ELVDD via the second switching element SW2, the data line Dm, the fourth transistor M4, the third transistor M3, and the second transistor M2 according to the application of the signals as above. When the second current is sunk in the first current sink unit 186, the second voltage $V_{G1_1}$ is applied to the first current sink unit 186.

That is, the second voltage $V_{G1_1}$ is as follows:

$$V_{G1_1} = ELVDD - \frac{1}{2}\sqrt{\frac{2\beta I_{MAX}}{\mu C_{OX}(W/L)}} - V_{th}$$

(μ: the mobility of the second transistor M2, W/L: the ratio of width to length of the channel of the second transistor M2, Vth: the threshold voltage of the second transistor M2)

As represented by the above equation, since the second current is sunk via the second transistor M2, the second voltage $V_{G1_1}$ includes the threshold voltage/mobility information of the second transistor M2.

Next, as shown in FIG. 8C, in a second period of the second non-display period, the previous scan signal Sn-1 is applied at a low level, the scan signal Sn is applied at a high level, the sensing signal CLn is applied at a low level, and the emission control signal En is applied at a high level so that the third transistor M3, the fourth transistor M4, and the fifth transistor M5 within the pixel circuit of the pixel 140 are turned on. Also, because the fifth transistor M5 is turned on, the second transistor M2 is diode-connected and turned on.

Further, because the scan signal Sn-1 of the previous stage is applied at a low level, the sixth transistor M6 is turned on. As a result, the reference voltage Vref applied to the first electrode of the sixth transistor M6 is applied to the first node A.

Also, in the switching unit 170 the first switch sw1 is turned off and the second switch sw2 is turned on so that the pixel 140 is coupled to the sensor 180.

Further, within the sensing circuit 181 the first switching element SW1 coupled to the current source unit 185 is turned off, the second switching unit SW2 coupled to the first current sink unit 186 is turned off and the third switching unit SW3 coupled to the second current sink unit 187 is turned on. At this time, the third current sunk in the second current sink unit 187 may be βImax as an example as shown (β is a constant) in FIG. 8C.

In other words, the third current corresponds to four times the current sunk in the first current sink unit 186. However, this is only one embodiment and the present invention is not limited thereto. By way of example, the third current corresponds to 4j (j is an integer) times the second current.

Also, the cathode electrode of the organic light emitting diode OLED is applied with a high-level voltage rather than the second voltage ELVSS. This is to prevent the current sunk in the second current sink unit 187 from being supplied to the organic light emitting diode(OLED).

The second current sink unit 187 sinks the third current, that is, βImax from the first power supply ELVDD via the third switching element SW3, the data line Dm, the fourth transistor M4, the third transistor M3, and the second transistor M2 according to the application of the signal as above. When the third current is sunk in the second current sink unit 187, the third voltage $V_{G1_2}$ is applied to the second current sink unit 187.

That is, the third voltage $V_{G1_2}$ is as follows:

$$V_{G1_2} = ELVDD - \sqrt{\frac{2\beta I_{MAX}}{\mu C_{OX}(W/L)}} - V_{th}$$

As represented by the equation, since the third current is sunk via the second transistor M2, the third voltage $V_{G1_2}$ includes the threshold voltage/mobility information of the second transistor M2.

When the second voltage $V_{G1_1}$ and the third voltage $V_{G1_2}$ through the first and second current sink units 186 and 187 are measured, the information corresponding to the difference of the second voltage $V_{G1_1}$ and the third voltage $V_{G1_2}$ is supplied to the ADC 182.

At this time, the absolute value of the difference (|second voltage−third voltage|) between the second voltage and the third voltage is $$V_{G1_2} - V_{G1_1} = \frac{1}{2}\sqrt{\frac{2\beta I_{MAX}}{\mu C_{OX}(W/L)}}.$$

As shown, this equation has the mobility information of the second transistor M2.

Therefore, the ADC 182 converts the difference between the second voltage $V_{G1_1}$ and the third voltage $V_{G1_2}$ supplied from the sensing circuit 181 to the second digital value and the memory 191 stores the second digital value supplied from the ADC 182. In practice, the memory 191 stores the mobility information of the respective driving transistors M2 of all pixels 140 included in the display region 130.

In other words, the memory 191 stores the first digital value and the second digital value supplied from the ADC 182, through the operations illustrated in FIGS. 8A to 8C. As a result, the memory 191 stores the mobility information of the second transistor M2 and the degradation information of the organic light emitting diode OLED of each pixel 140 included in the display region 130.

The conversion circuit 192 uses the first digital value and the second digital value stored in the memory 191 to convert the input data Data transferred from the timing controller 150 to the corrected data Data' so that the image with substantially uniform luminance can be displayed irrespective of the degradation of the organic light emitting diodes OLEDs and the mobility of the driving transistor M2.

In other words, the conversion circuit 192 converts the data Data input from the timing controller 150 to the corrected data Data' by determining the degradation degree of the organic light emitting diode OLED included in each pixel 140 by referencing the first digital value and at the same time, measuring the mobility of the second transistor M2 included in each pixel 140 by referencing the second digital value. Thereafter, the conversion circuit 192 supplies the corrected data Data' to the data driver 120. This way, the image with substantially uniform luminance can be displayed irrespective of the mobility of the second transistor M2 while reducing or preventing the generation of light with low luminance as the organic light emitting diode OLED is degraded.

Next, the data signals corresponding to the corrected data ("converted data") Data' are provided to the pixels 140 and ultimately, the pixels are emitted to have gray levels corresponding to the data signals.

The process of emitting light by inputting the corrected data Data' to the pixels 140 is divided into an initialization period, a threshold voltage storing (Vth storing) period, a period in which the voltages corresponding to the data signals are charged, that is, the programming period, and an emission period. The operations of these periods will be described below with reference to FIGS. 8D to 8G.

Figure 8D:
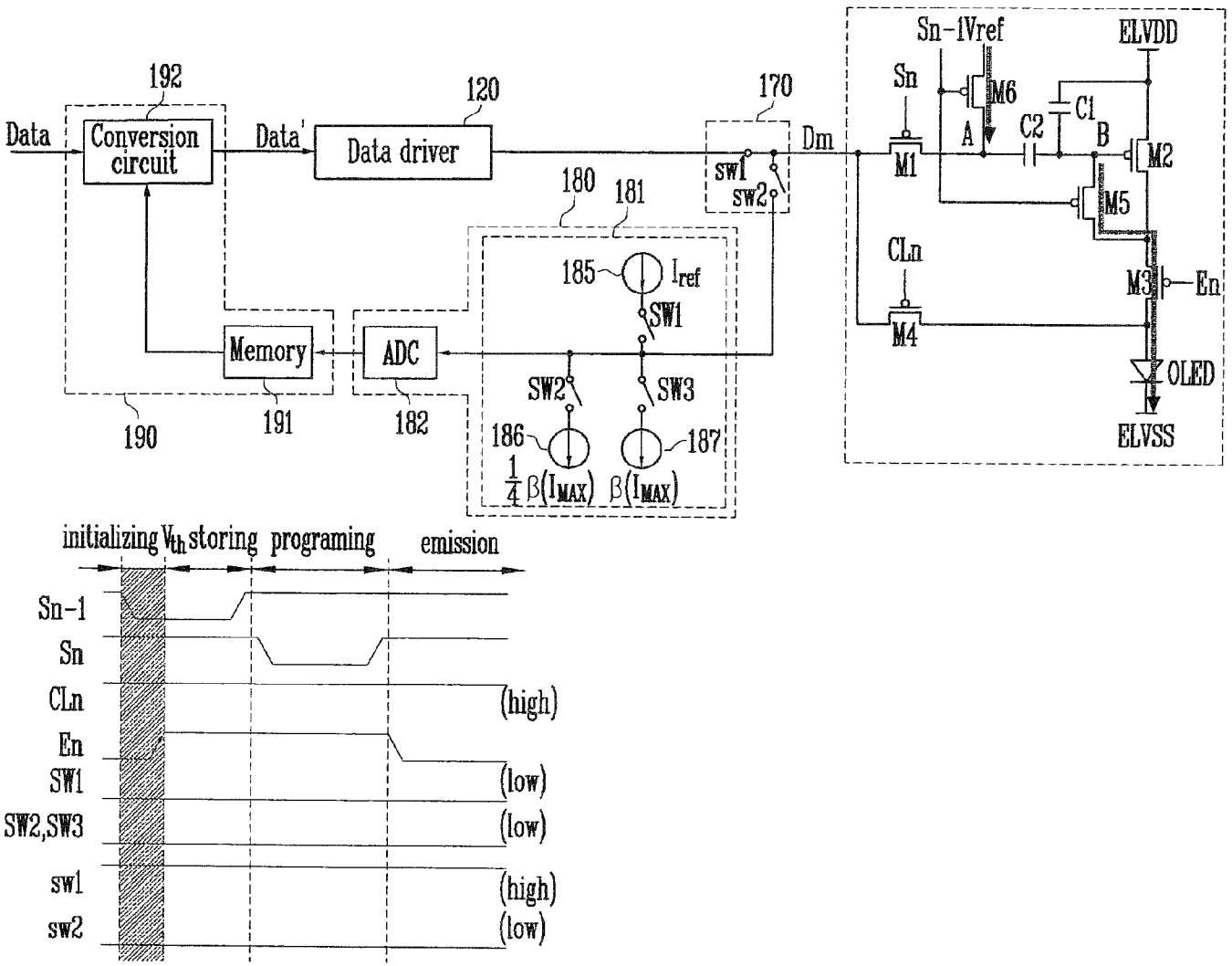

FIG. 8D corresponds to the initialization period. In the initialization period, the previous scan signal Sn-1 is applied at a low level, the scan signal Sn is applied at a high level, the sensing signal CLn is applied at a high level, and the emission control signal En is applied at a low level as shown in FIG. 8D.

Accordingly, the sixth transistor M6 is turned on so that the reference voltage Vref is applied to the first node A and the fifth transistor M5 and the third transistor M3 are turned on so that the gate electrode of the second transistor M2, that is, the voltage of the second node B is initialized to the second voltage ELVSS applied to the cathode electrode of the organic light emitting diode OLED.

At this time, the reference voltage Vref is a high-level voltage and can be supplied by the first power supply ELVDD, and the second power supply ELVSS can be supplied by a ground power supply (GND, 0V). In other words, the voltage of the second node B can be initialized to 0V.

Further, in the switching unit 170 the first switch sw1 is turned on and the second switch sw2 is turned off so that the pixel 140 is coupled to the data driver 120. Therefore, all the first to third switching elements SW1, SW2, SW3 within the sensing circuit 181 are turned off.

Figure 8E:
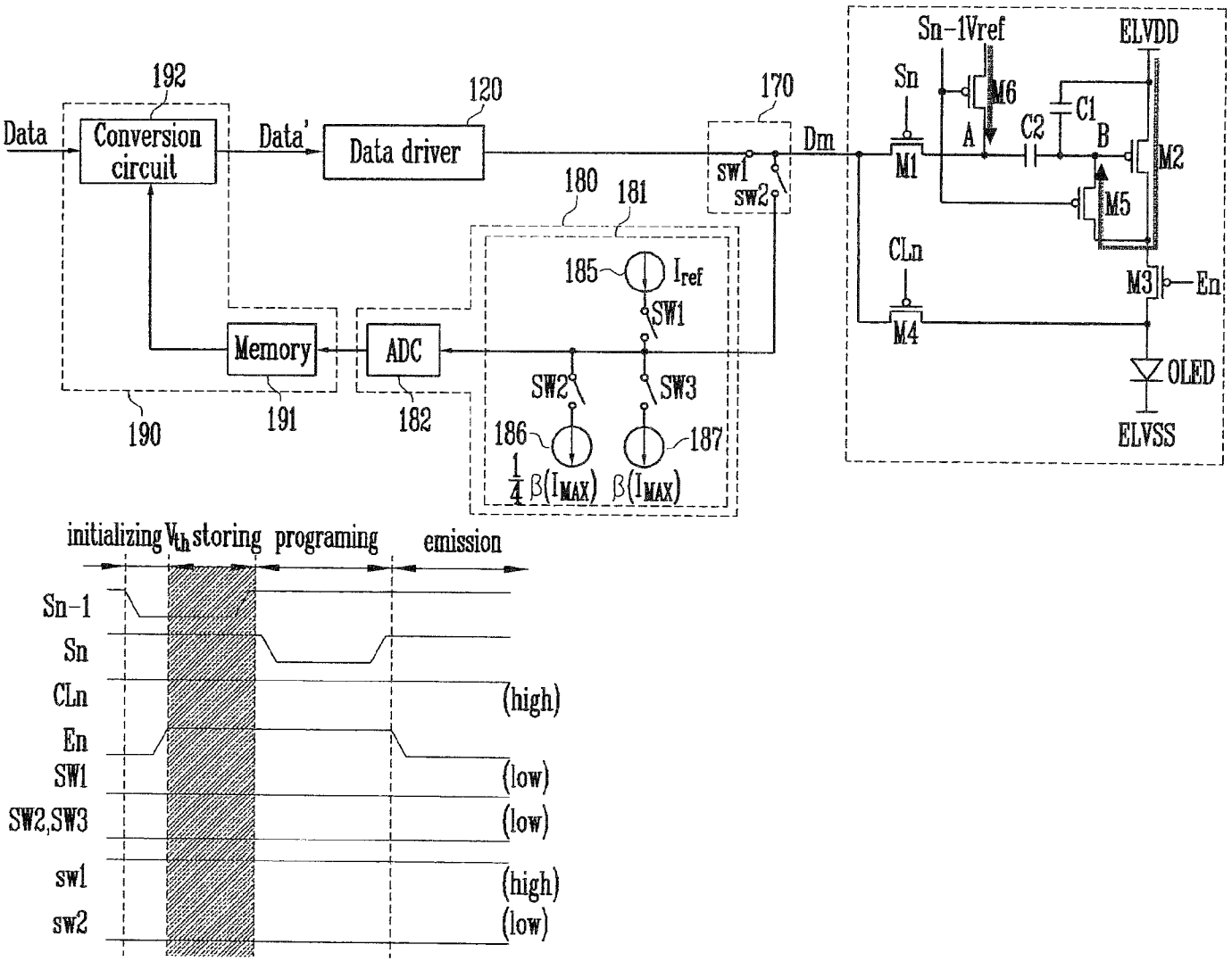

FIG. 8E corresponds to the threshold voltage storing (Vth storing) period. In the Vth storing period, the previous scan signal Sn-1 is applied at a low level, the scan signal Sn is applied at a high level, the sensing signal CLn is applied at a high level, and the emission control signal En is applied at a low level as shown so that the fifth and sixth transistors M5 and M6 within the pixel circuit of the pixel 140 are turned on. Because the fifth transistor M5 is turned on, the second transistor M2 is diode-connected and turned on.

In other words, the first node A is applied with the same reference voltage Vref as in the previous period and the second node B is applied with the voltage ELVDD-Vth corresponding to the difference between the first voltage ELVDD and the threshold voltage Vth of the second transistor M2 using the turn on of the second and fifth transistors M2 and M5.

Therefore, as described above when the reference voltage Vref is equal to the first voltage EVLDD, the second capacitor C2 coupled between the first node A and the second node B is stored with the threshold voltage Vth of the second transistor M2.

Also, as in the initialization period, in the switching unit 170 the first switch sw1 is turned on and the second switch sw2 is turned off so that the pixel 140 is coupled to the data driver 120. Accordingly, all the first to third switching elements SW1, SW2, SW3 within the sensing circuit 181 are turned off.

Figure 8F:
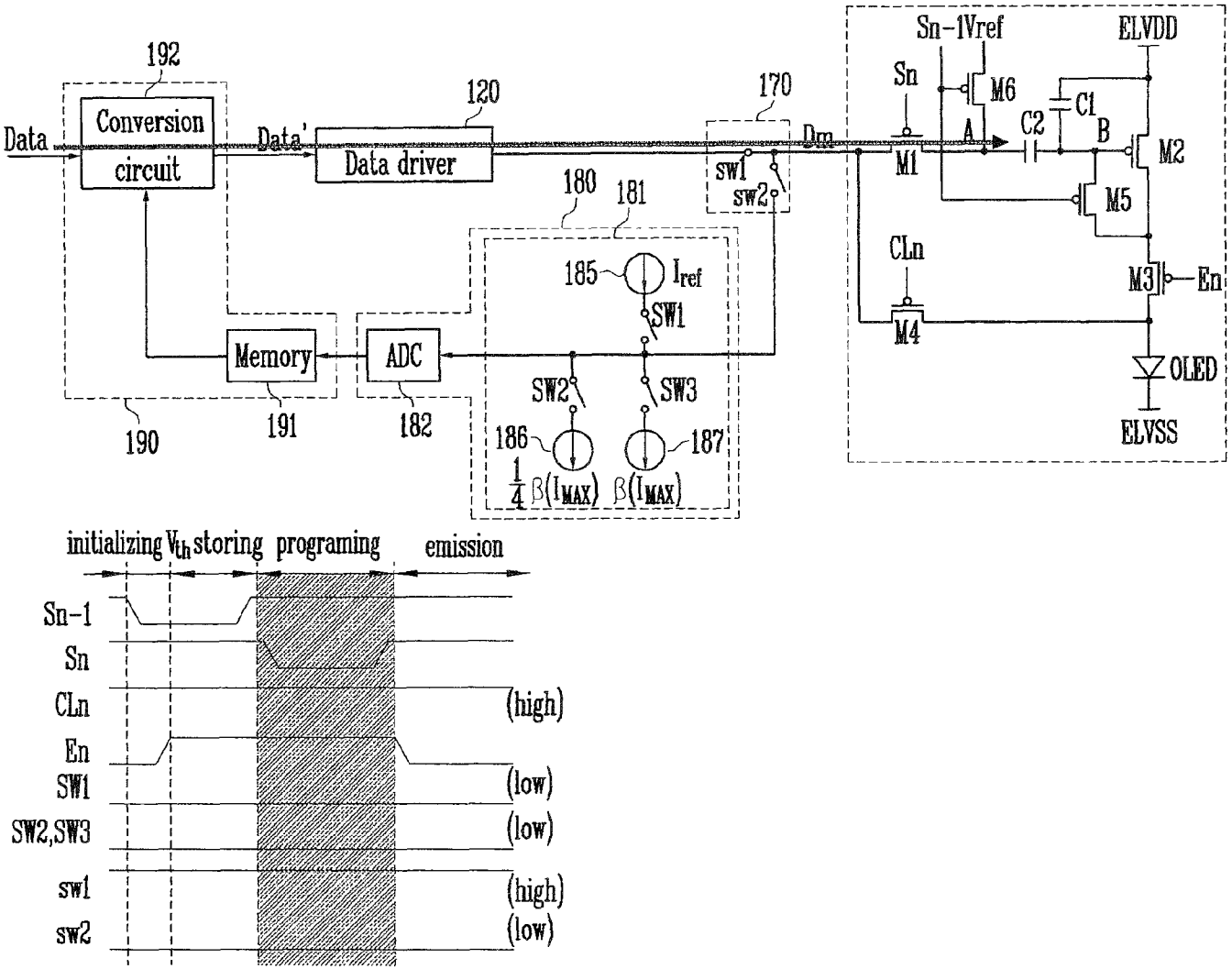

FIG. 8F corresponds to the period where the voltages corresponding to the data signals are charged, that is, the programming period. In the programming period, the previous scan signal Sn-1 is applied at a high level, the scan signal Sn is applied at a low level, the sensing signal CLn is applied at a high level, and the emission control signal En is applied at a high level as shown so that only the first transistor M1 within the pixel circuit of the pixel 140 is turned on.

Accordingly, the data signals output from the data driver 120 can be applied to the pixel circuit of the pixel 140.

At this time, the data signals are data signals corresponding to the converted corrected data Data' so that the image with substantially uniform luminance can be displayed irrespective of the degradation of the organic light emitting diode OLED and the mobility of the driving transistor M2.

The data signals are applied to the pixel circuit of the pixel so that the voltage of the first node A is changed. As a result, the voltage of the second node B is changed through the coupling of the first and second capacitors C1 and C2.

Accordingly, the voltage applied to the second voltage B through the programming period is as follows as an example:

$$ELVDD-\left(\frac{C2}{C1+C2}\right)\sqrt{\left(\frac{100}{100-\alpha}\right)\left(\frac{\text{Data}}{2^k-1}\right)\frac{2\beta I_{MAX}}{\mu C_{OX}(W/L)}}-V_{th}$$

where $100/(100-\alpha)$ is a current ratio for compensating for the degradation degree of the organic light emitting diode OLED, $\text{Data}/(2^k-1)$ is a value controlled to represent the gray levels using the first input data Data (k is the number of bits of DAC within the data driver), β is current ratio of sunk current ((¼)Imax, Imax).

Also, as in the previous initialization period, in the switching unit 170 the first switch sw1 is turned on and the second switch sw2 is turned off so that the pixel 140 is coupled to the data driver 120. Therefore, all the first to third switching elements SW1, SW2, SW3 within the sensing circuit 181 are turned off.

Figure 8G:
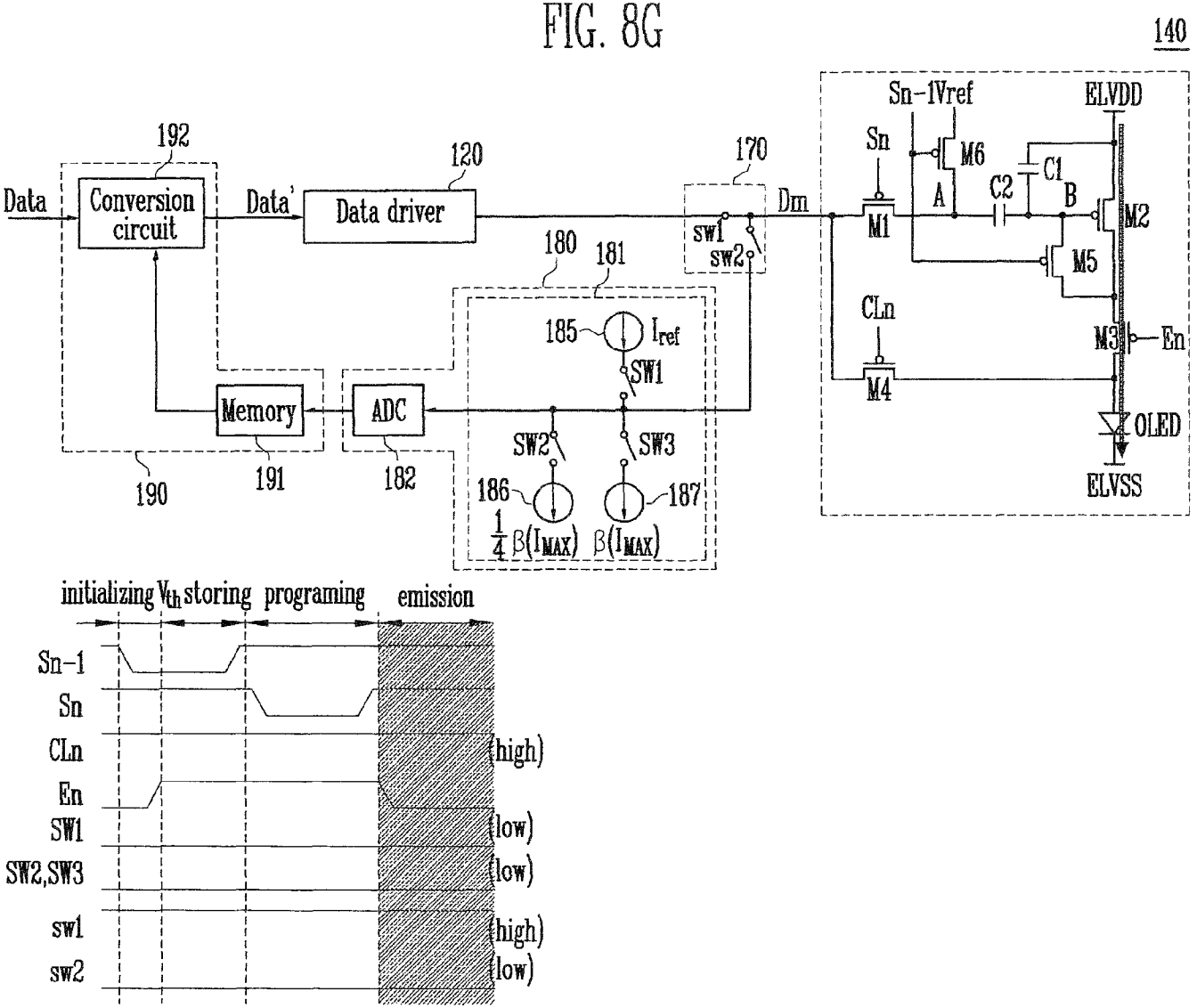

Finally, FIG. 8G corresponds to the period where the organic light emitting diodes OLEDs are light emitted at the gray levels corresponding to the charged data signals. In the light emission period, the previous scan signal Sn-1 is applied at a high level, the scan signal Sn is applied at a high level, the sensing signal CLn is applied at a high level, and the emission control signal En is applied at a low level as shown in FIG. 8G. As a result, the third transistor M3 is turned on.

In other words, the third transistor M3 is turned on so that the current corresponding to the programmed voltage is applied to the organic light emitting diode OLED via the third transistor M3. As a result, the organic light emitting diode OLED finally light emits light at the gray level corresponding to the current.

Also, as in the previous initialization period, in the switching unit 170 the first switch sw1 is turned on and the second switch sw2 is turned off so that the pixel 140 is coupled to the data driver 120. Therefore, all the first to third switching elements SW1, SW2, SW3 within the sensing circuit 181 are turned off.

The current $I_D$ corresponding to the programmed voltage can be represented by the following equation.

$$\begin{aligned} I_D &= \frac{1}{2}\mu C_{OX}(W/L)(V_{SG}-V_{th})^2 \\ &= \frac{1}{2}\mu C_{OX}(W/L)\Bigg(ELVDD-\Bigg(ELVDD-\Bigg(\frac{C2}{C1+C2}\Bigg) \\ &\quad \sqrt{\Bigg(\frac{100}{100-\alpha}\Bigg)\Bigg(\frac{\text{Data}}{2^k-1}\Bigg)\frac{2\beta I_{MAX}}{\mu C_{OX}(W/L)}}-V_{th}\Bigg)-V_{th}\Bigg)^2 \\ &= \Bigg(\frac{C2}{C1+C2}\Bigg)^2\Bigg(\frac{100}{100-\alpha}\Bigg)\Bigg(\frac{\text{Data}}{2^k-1}\Bigg)\beta I_{MAX} \end{aligned}$$

As can be appreciated from the above equation, the current input to the organic light emitting diode OLED compensates for the degradation degree of the organic light emitting diode OLED and does not reflect the characteristics of the mobility and threshold voltage of the driving transistor M2. Therefore, an image with substantially uniform luminance can be displayed irrespective of the degradation of the organic light emitting diode OLED and the mobility of the driving transistor M2.

FIGS. 9A to 9G are schematic circuit diagrams for illustrating a driving method of an organic light emitting display according to the second embodiment of the present invention.

For convenience of description, FIGS. 9A to 9G will illustrate the second embodiment only in reference to the pixel 140' coupled to the $n^{th}$ scan line Sn and the $m^{th}$ data line Dm (shown in FIG. 4).

As described above, the sensing of the mobility information of the driving transistor may be performed each time the power supply is applied to the organic light emitting display or may be performed before the product is distributed so that the performance results are pre-stored. Using the second method, the pre-stored information for the mobility information of the driving transistor can be used without performing the extraction of the mobility information each time the power supply is applied.

FIGS. 9A to 9G illustrate the example in which the sensing of the mobility information of the driving transistor is performed each time the power supply is applied to the organic light emitting display. However, it should be apparent to those skilled in the art that the present invention is not limited thereto.

Hereinafter, the driving method of the organic light emitting display according to one embodiment of the present invention will be described in more detail with reference to FIGS. 9A to 9G.

Figure 9A:
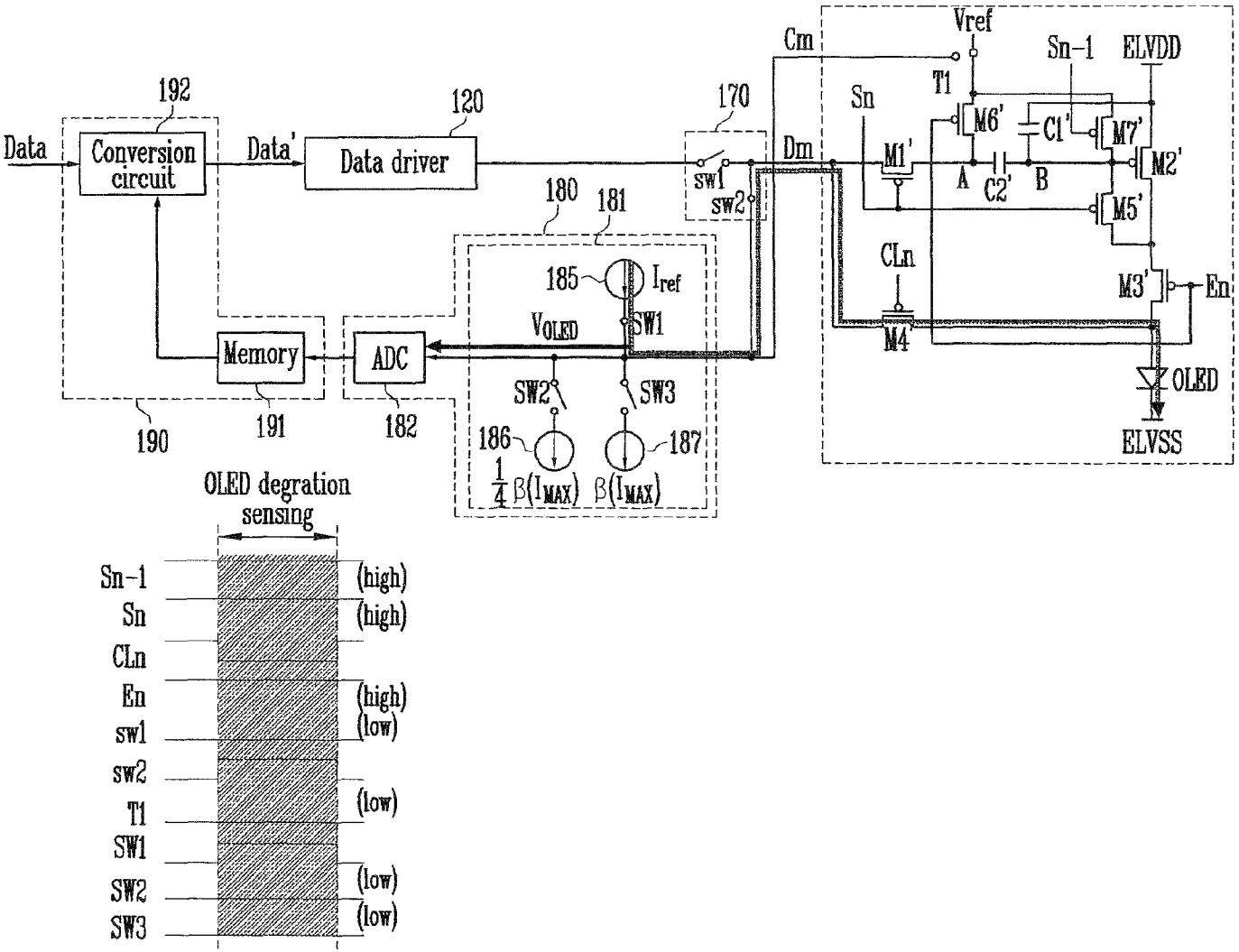
FIG. 9A to 9G are schematic circuit diagrams for illustrating a driving method of an organic light emitting display according to a second embodiment of the present invention.

First, FIG. 9A illustrates an operation during a first non-display period from after the power supply is applied to the organic light emitting display to before the image is displayed.

The operation for sensing (OLED degradation sensing) the degradation information on the organic light emitting diode OLED is performed in the first non-display period.

As shown in FIG. 9A, in the first non-display period the scan signals Sn and Sn-1 are applied at a high level, the sensing signal CLn is applied at a low level, and the emission control signal En is applied at a high level so that only the fourth transistor M4' within the pixel circuit of the pixel 140' is turned on.

Also, in the switching unit 170 the first switch sw1 is turned off and the second switch sw2 is turned on so that the pixel 140' is coupled to the sensor 180.

Further, within the sensing circuit 181 the first switching element SW1 coupled to the current source unit 185 is turned on and the second and third switching elements SW2 and SW3 coupled to the first and second current sink units 186 and 187 are turned off. At this time, for example, the first current Iref supplied by the current source unit 185 can be set to the current value Imax that flows to the organic light emitting diode OLED when the pixel 140' is light-emitted at maximum luminance. The first current Iref supplied by the current source unit 185 according to the application of the signals as above is applied to the organic light emitting diode OLED via the data line Dm and the fourth transistor M4' within the pixel 140'.

Therefore, the voltage (predetermined voltage or first voltage) applied to the anode electrode of the organic light emitting diode OLED is equally applied to the sensing circuit 181 and the first voltage is supplied to the ADC 182.

In other words, the first voltage generated through the current source unit 185 has the degradation information of the organic light emitting diode OLED.

The ADC 182 converts the first voltage supplied from the sensing circuit 181 to the first digital value and the memory 191 stores the first digital value supplied by the ADC 182. In practice, the memory 191 stores the degradation information of the respective organic light emitting diodes OLEDs of all pixels 140' included in the display region.

Figure 9B:
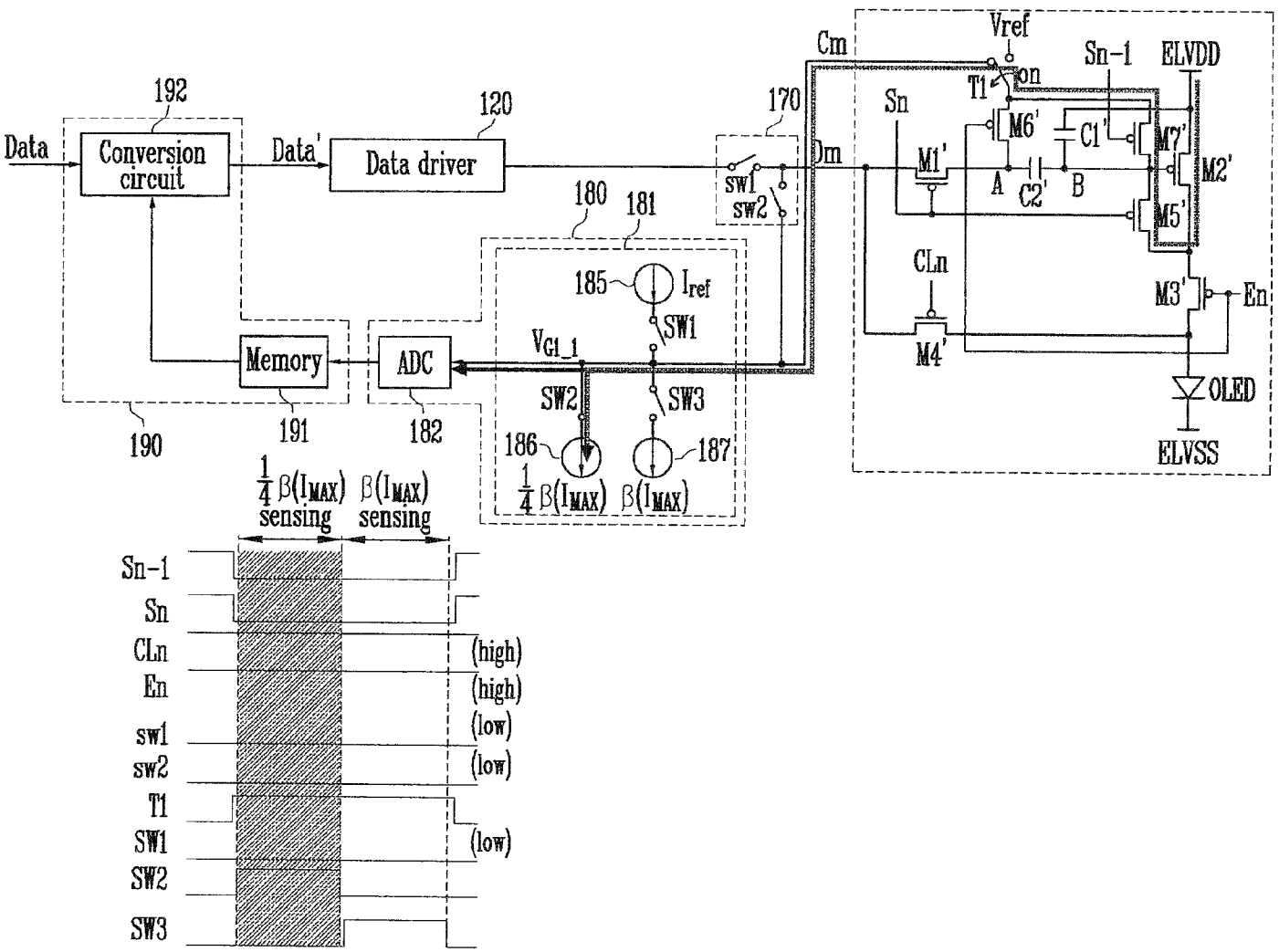
Figure 9C:
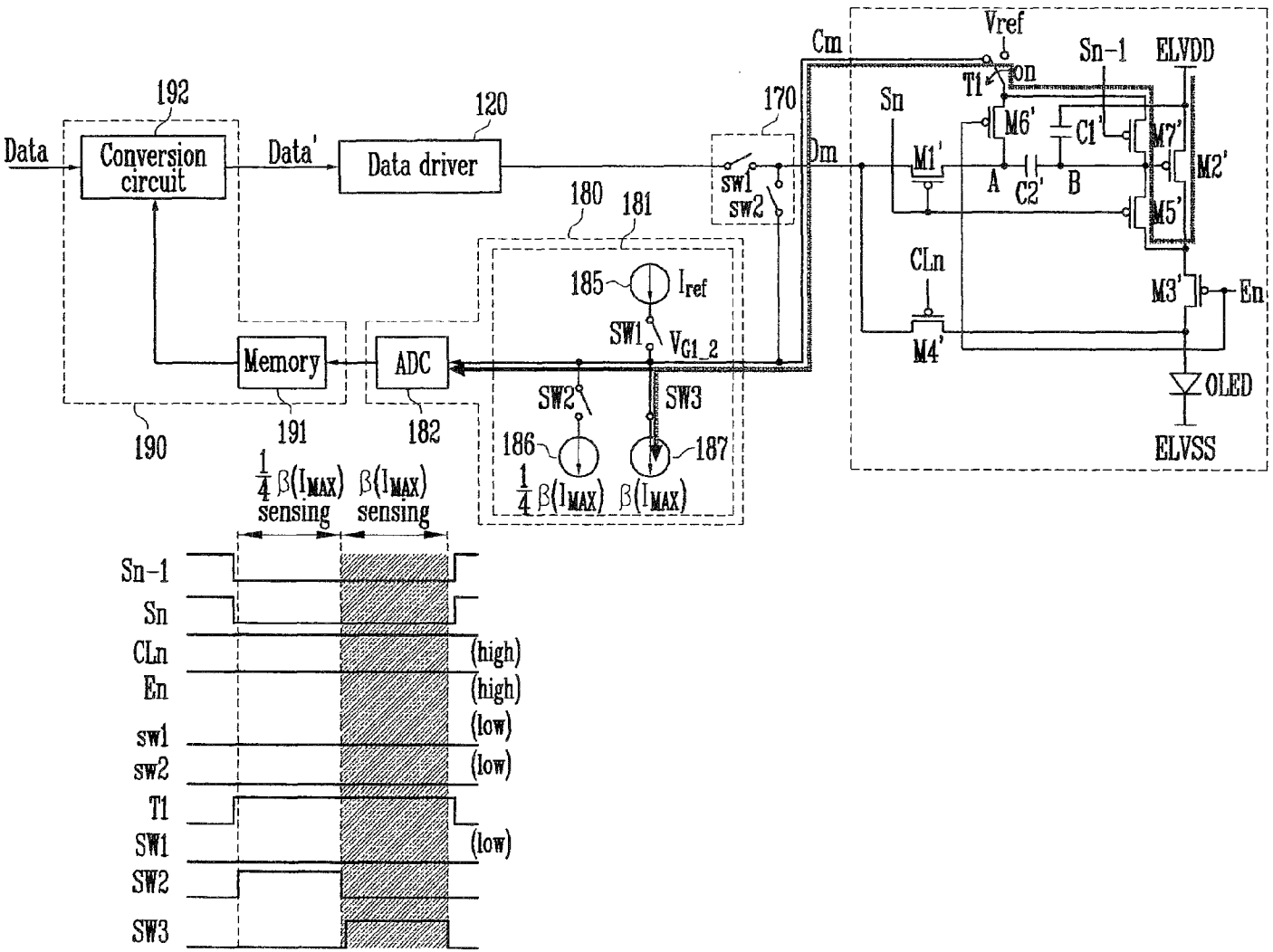

Next, FIGS. 9B and 9C illustrate an operation from after the first non-display period of the FIG. 9A to a second non-display period prior to the display of image.

The sensing operation of the mobility information of the second transistor M2' as the driving transistor within the pixel 140' is performed in the second non-display period.

In the described embodiment of the present invention, in order to sense the mobility information of the second transistor M2', the second non-display period is divided into two periods so that the operations for sinking currents are performed independently.

In other embodiments, as described above, the sensing of the mobility information of the second transistor M2' may be performed before the product is distributed so that the performance results are pre-stored. This way, the pre-stored information of the mobility information of the driving transistor can be used without performing the extraction of the mobility information each time the power supply is applied.

As shown in FIG. 9B, in a first period of the second non-display period, the previous scan signal Sn-1 of a previous row of pixels is applied at a low level, the scan signal Sn is applied at a low level, the sensing signal CLn is applied at a high level, and the emission control signal En is applied at a high level so that the first transistor M1', and the fifth and seventh transistors M5' and M7' within the pixel circuit of the pixel 140' are turned on. Also, because the fifth transistor M5' is turned on, the second transistor M2' is diode-connected to be turned on.

Further, a high level signal is applied to the switching element T1 included in the pixel 140' to turn on the switching element T1 so that the pixel 140' is coupled to the sensing unit 180 through the control line Cm. At this time, in the switching unit 170 both the first and second switches sw1 and sw2 are turned off.

Further, within the sensing circuit 181 the first switching element SW1 coupled to the current source unit 185 is turned off, the second switching unit SW2 coupled to the first current sink unit 186 is turned on and the third switching unit SW3 coupled to the second current sink unit 187 is turned off. At this time, the second current sunk in the first current sink unit 186 may be (¼)βImax as an example as shown in FIG. 9B, where β is a constant.

The first current sink unit 186 sinks the second current, that is, (¼)βImax from the first power supply ELVDD via the second switching element SW2, the control line Cm, the switching element T1 in the pixel, the seventh transistor M7', the fifth transistor M5', and the second transistor M2' according to the application of the signal as above. When the second current is sunk in the first current sink unit 186, the second voltage $V_{G1_1}$ is applied to the first current sink unit 186.

That is, the second voltage $V_{G1_1}$ is as follows:

$$V_{G1_1} = ELVDD - \frac{1}{2}\sqrt{\frac{2\beta I_{MAX}}{\mu C_{OX}(W/L)}} - V_{th}$$

(μ: the mobility of the second transistor M2', W/L: the ratio of width to length of the channel of the second transistor M2', Vth: the threshold voltage of the second transistor M2')

As represented by the above equation, since the second current is sunk via the second transistor M2', the second voltage $V_{G1_1}$ includes the threshold voltage/mobility information of the second transistor M2'.

Next, as shown in FIG. 9C, in a second period of the second non-display period, the previous scan signal Sn-1 is applied at a low level, the scan signal Sn is applied at a low level, the sensing signal CLn is applied at a high level, and the emission control signal En is applied at a high level so that the first transistor M1', the fifth transistor M5', and the seventh transistor M7' within the pixel circuit of the pixel 140' are turned on. Also, because the fifth transistor M5' is turned on, the second transistor M2' is diode-connected and turned on.

Further, a high level signal is applied to the switching element T1 included in the pixel 140' to turn on the switching element T1 so that the pixel 140' is coupled to the sensing unit 180 through the control line Cm. At this time, in the switching unit 170 all the first and second switches sw1 and sw2 are turned off. Further, within the sensing circuit 181 the first switching element SW1 coupled to the current source unit 185 is turned off, the second switching unit SW2 coupled to the first current sink unit 186 is turned off and the third switching unit SW3 coupled to the second current sink unit 187 is turned on. At this time, the third current sunk in the second current sink unit 187 may be βImax as an example as shown in FIG. 9C, where β is a constant.

In other words, the third current corresponds to four times the current sunk in the first current sink unit 186. However, this is only one embodiment and the present invention is not limited thereto. By way of example, the third current corresponds to 4j (j is an integer) times the second current.

The second current sink unit 187 sinks the third current, that is, βImax from the first power supply ELVDD via the third switching element SW3, the control line Cm, the switching element T1 in the pixel 140', the seventh transistor M7', the fifth transistor M5', and the second transistor M2' according to the application of the signal as above. When the third current is sunk in the second current sink unit 187, the third voltage $V_{G1_2}$ is applied to the second current sink unit 187.

That is, the third voltage $V_{G1_2}$ is as follows:

$$V_{G1_2} = ELVDD - \sqrt{\frac{2\beta I_{MAX}}{\mu C_{OX}(W/L)}} - V_{th}$$

As represented by the equation, since the third current is sunk via the second transistor M2', the second voltage $V_{G1_2}$ includes the threshold voltage/mobility information of the second transistor M2'.

When the second voltage $V_{G1_1}$ and the third voltage $V_{G1_2}$ through the first and second current sink units 186 and 187 are measured, the information corresponding to the difference of the second voltage $V_{G1_1}$ and the third voltage $V_{G1_2}$ is supplied to the ADC 182.

At this time, the absolute value of the difference (|second voltage−third voltage|) between the second voltage and the third voltage is $$V_{G1_2} - V_{G1_1} = \frac{1}{2}\sqrt{\frac{2\beta I_{MAX}}{\mu C_{OX}(W/L)}}.$$

As shown, this equation has the mobility information of the second transistor M2'.

Therefore, the ADC 182 converts the difference between the second voltage $V_{G1_1}$ and the third voltage $V_{G1_2}$ supplied from the sensing circuit 181 to the second digital value and the memory 191 stores the second digital value supplied from the ADC 182. In practice, the memory 191 stores the mobility information of the respective driving transistors M2' of all pixels 140' included in the display region.

In other words, the memory 191 stores the first digital value and the second digital value supplied from the ADC 182, through the operations illustrated in FIGS. 9A to 9C. As a result, the memory 191 stores the mobility information of the second transistor M2' and the degradation information of the organic light emitting diode OLED of each pixel 140' included in the display region 130.

The conversion circuit 192 uses the first digital value and the second digital value stored in the memory 191 to convert the input data Data transferred from the timing controller 150 to the corrected data Data' so that the image with substantially uniform luminance can be displayed irrespective of the degradation of the organic light emitting diodes OLEDs and the mobility of the driving transistor M2'.

In other words, the conversion circuit 192 converts the data Data input from the timing controller 150 to the corrected data Data' by determining the degradation degree of the organic light emitting diode OLED included in each pixel 140' by referencing the first digital value and at the same time, measuring the mobility of the second transistor M2' included in each pixel 140' by referencing the second digital value. Thereafter, the conversion circuit 192 supplies the corrected data Data' to the data driver 120. This way, the image with substantially uniform luminance can be displayed irrespective of the mobility of the second transistor M2' while reducing or preventing the generation of light with low luminance as the organic light emitting diode OLED is degraded.

Next, the data signals corresponding to the corrected data ("converted data") Data' are provided to the pixels 140' and ultimately, the pixels are emitted to have gray levels corresponding to the data signals.

The process of emitting light by inputting the corrected data Data' to the pixels 140' is divided into an initialization period, a threshold voltage storing period and a period in which the voltages corresponding to the data signals are charged (programmed) (Vth storing and programming) period, a boosting period, and an emission period. The operations of these periods will be described below with reference to FIGS. 9D to 9G.

Figure 9D:
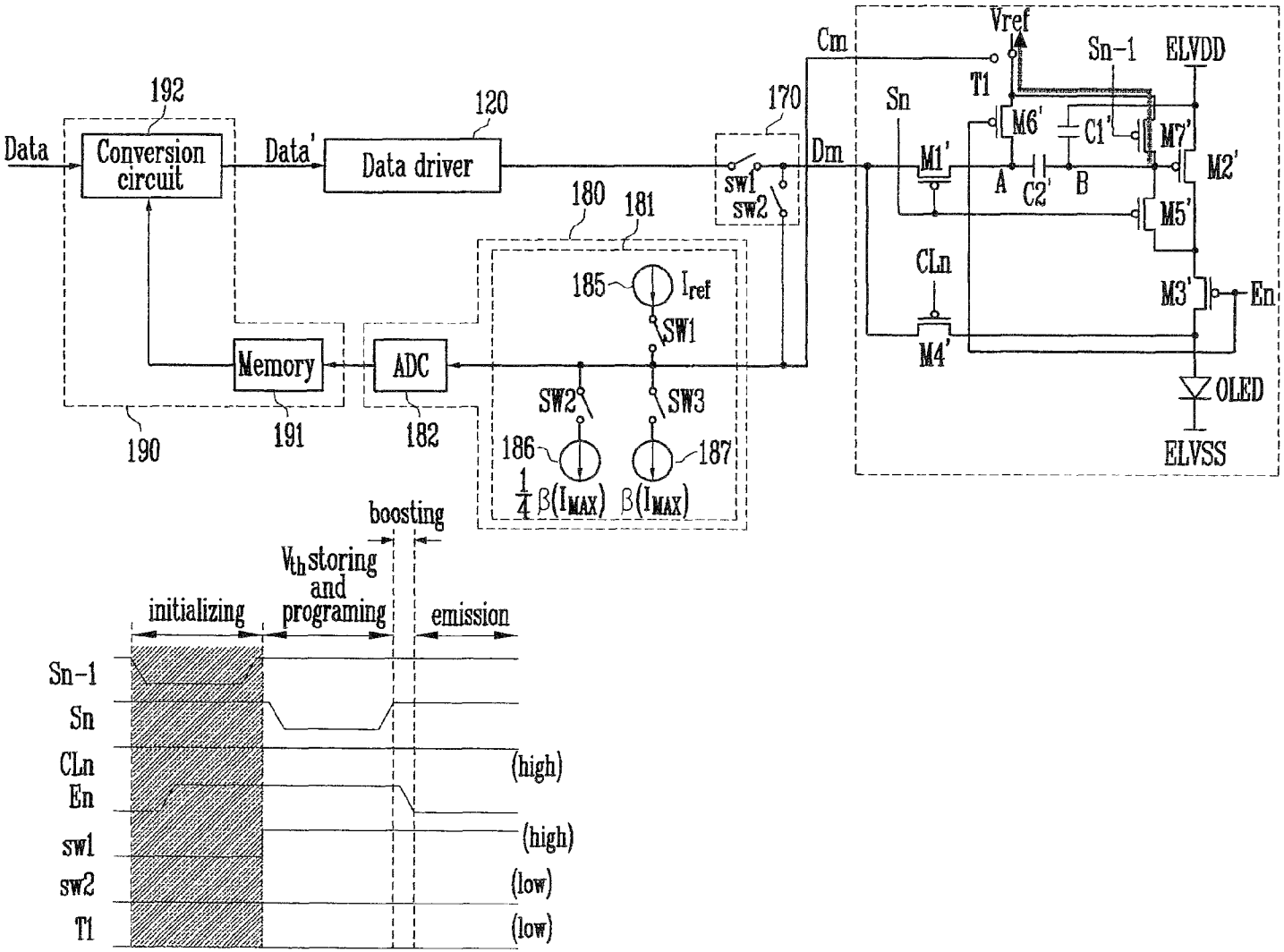

FIG. 9D corresponds to the initialization period. In the initialization period, the previous scan signal Sn-1 is applied at a low level, the scan signal Sn is applied at a high level, the sensing signal CLn is applied at a high level, and the emission control signal En is applied at a low level as shown in FIG. 9D.

Further, the switching element T1 is turned off so that the reference voltage Vref is applied to the first electrode of the sixth transistor M6'.

At this time, the reference voltage Vref is a ground voltage (GND, 0V), for example.

Accordingly, the seventh transistor M7' is turned on so that the voltage applied to the second electrode of the seventh transistor M7', that is, the gate voltage of the second transistor M2' is initialized to the reference voltage Vref.

Also, in the switching unit 170, both the first switch sw1 and the second switch sw2 are turned off so that the pixel 140' is not coupled to the data driver 120 and the sensing unit 180 in the initialization period.

Figure 9E:
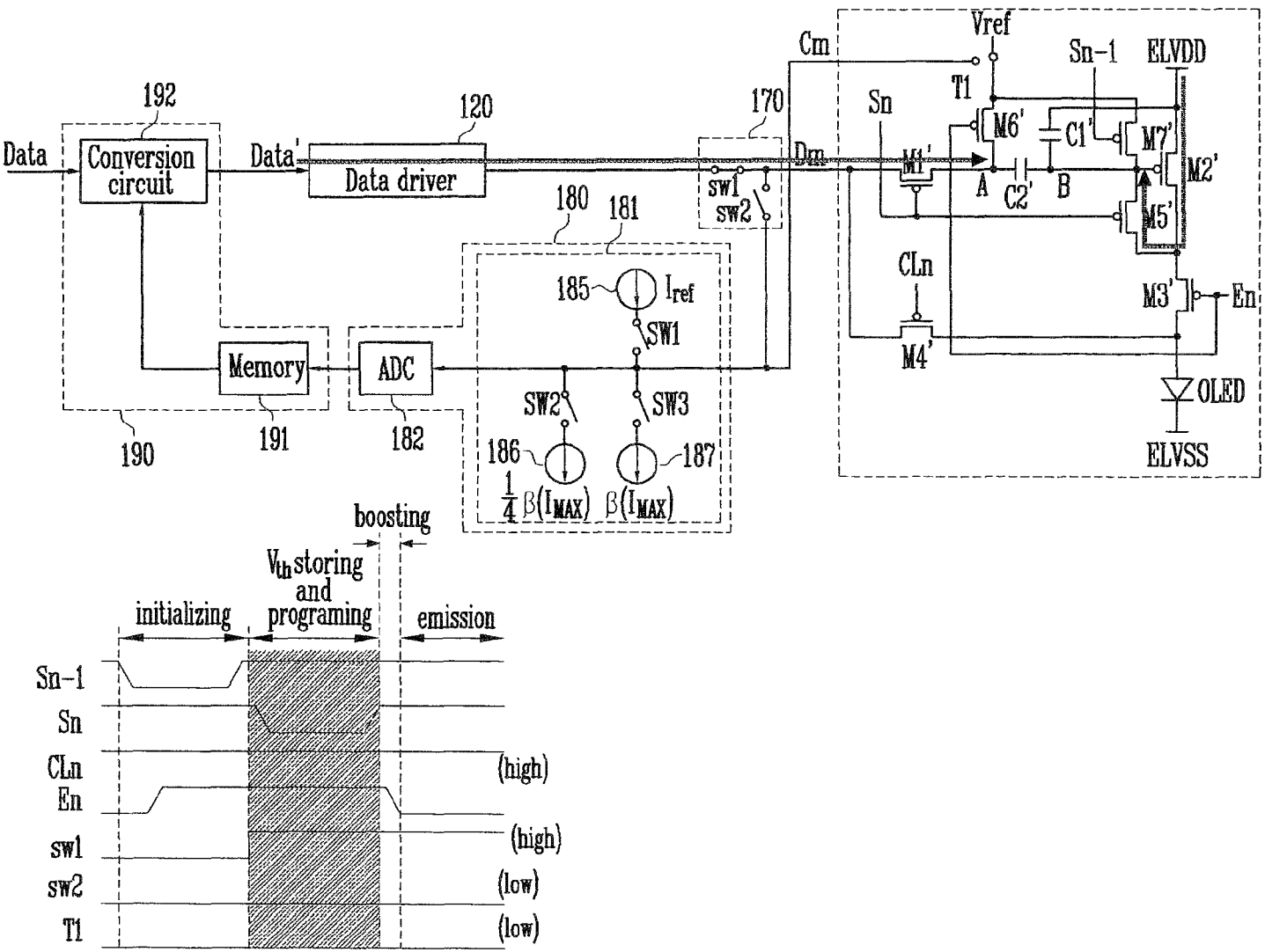

FIG. 9E corresponds to the threshold voltage storing and programming (Vth storing and programming) period. In the Vth storing and programming period, the previous scan signal Sn-1 is applied at a high level, the scan signal Sn is applied at a low level, the sensing signal CLn is applied at a high level, and the emission control signal En is applied at a high level as shown so that the switching element T1 is turned off to couple the first electrode of the sixth transistor M6' to the reference voltage (Vref) source.

Therefore, the first and fifth transistors M1' and M5' within the pixel circuit of the pixel 140' are turned on. Also, because the fifth transistor M5' is turned on, the second transistor M2' is diode-connected and turned on.

In other words, the second node B is applied with the voltage ELVDD-Vth corresponding to the difference between the first voltage ELVDD and the threshold voltage Vth of the second transistor M2' using the turn-on of the second and fifth transistors M2' and M5'.

Therefore, as described above when the reference voltage Vref is equal to the first voltage EVLDD, the capacitor C2 coupled between the first node A and the second node B is stored with the threshold voltage of the second transistor M2.

Also, in the switching unit 170 the first switch sw1 is turned on and the second switch sw2 is turned off so that the pixel 140' is coupled to the data driver 120. Accordingly, all the first to third switching elements SW1, SW2, SW3 within the sensing circuit 181 are turned off.

In other words, in the period in which the data signals applied from the data driver 120, that is, the data signals corresponding to the corrected data Data', are supplied to the pixel 140' and the data signals are applied to the first node A via the data line Dm and the first transistor M1'

At this time, the voltage applied to the first node A using the data signal is as follows as an example:

$$V_{ref} - \sqrt{\left(\frac{100}{100-\alpha}\right)\left(\frac{\text{Data}}{2^k-1}\right)\frac{2\beta I_{MAX}}{\mu C_{OX}(W/L)}}$$

where 100/(100−α) is a current ratio for compensating for the degradation degree of the organic light emitting diode OLED, Data/($2^k$−1) is a value controlled to represent the gray levels using the first input data Data (k is the number of bits of DAC within the data driver), β is current ratio of sunk current ((¼)Imax, Imax).

Figure 9F:
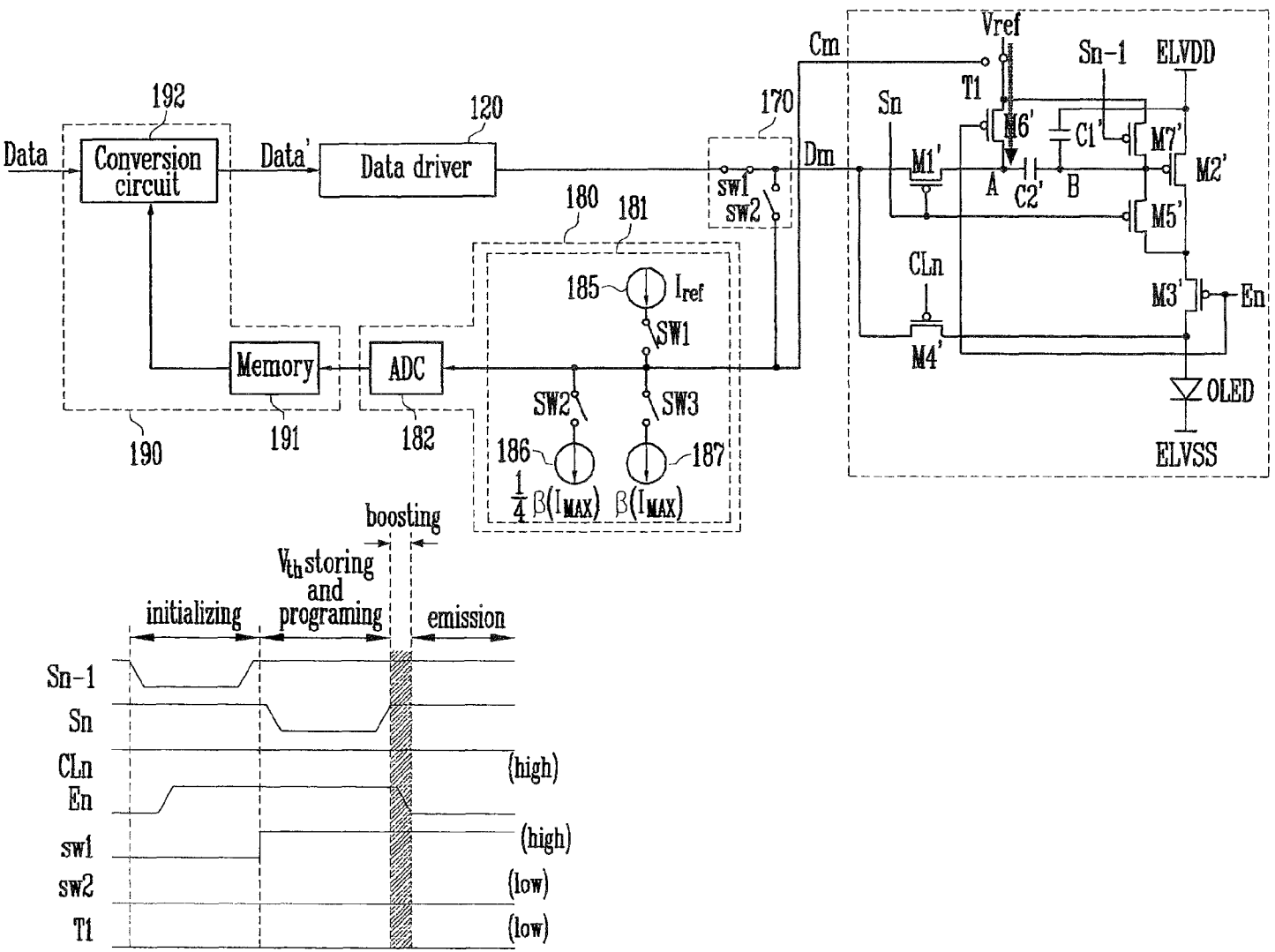

FIG. 9F corresponds to a boosting period. In the boosting period, the previous scan signal is applied at a high level, the scan signal Sn is applied at a high level, the sensing signal CLn is applied at a high level, and the emission control signal En is transitioned to low level as shown so that the sixth transistor M6' within the pixel circuit of the pixel 140' is turned on.

Therefore, the reference voltage Vref supplied to the first electrode of the sixth transistor M6' is applied to the first node A so that the voltage of the first node A is changed using the data signal applied in a previous programming period. Therefore, the voltage of the second node B is changed by boosting according to the first and second capacitors C1 and C2.

Accordingly, the voltage applied to the second node B through the boosting period is as follows as an example:

$$ELVDD - \left(\frac{C2}{C1+C2}\right)\sqrt{\left(\frac{100}{100-\alpha}\right)\left(\frac{\text{Data}}{2^k-1}\right)\frac{2\beta I_{MAX}}{\mu C_{OX}(W/L)}} - V_{th}$$

Also, as in the previous programming period, in the switching unit 170 the first switch sw1 is turned on and the second switch sw2 is turned off so that the pixel 140' is coupled to the data driver 120. Therefore, all the first to third switching elements SW1, SW2, SW3 within the sensing circuit 181 are turned off.

Figure 9G:
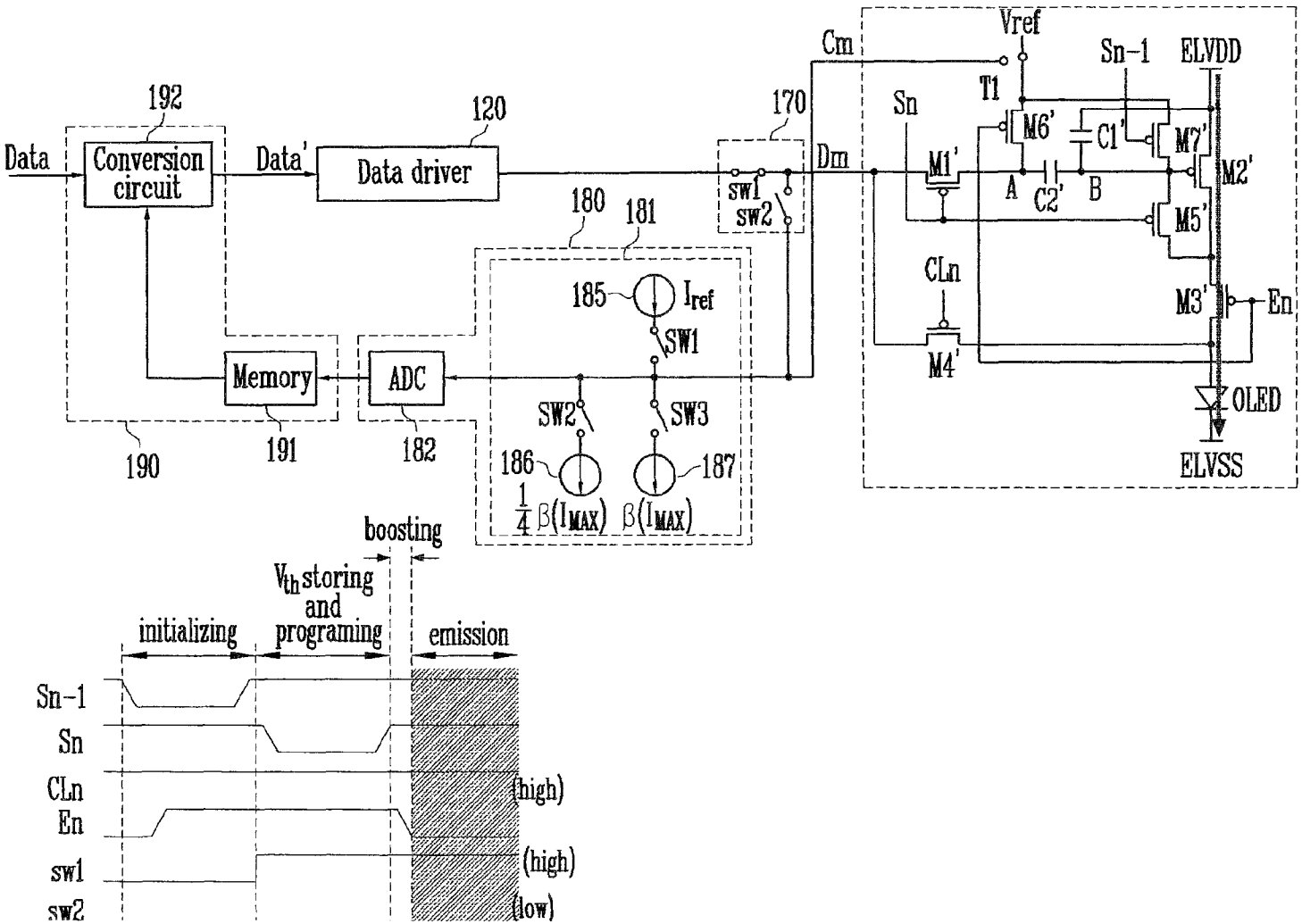

Finally, FIG. 9G corresponds to the period where the organic light emitting diodes OLEDs are light emitted at the gray levels corresponding to the charged data signals. In the light emission period, the previous scan signal Sn-1 is applied at a high level, the scan signal Sn is applied at a high level, the sensing signal CLn is applied at a high level, and the emission control signal En is applied at a low level as shown in FIG. 9G so that the third transistor M3' is turned on.

In other words, the third transistor M3' is turned on so that the current corresponding to the programmed voltage is applied to the organic light emitting diode OLED via the third transistor M3'. As a result, the organic light emitting diode OLED finally light emits light at the gray level corresponding to the current.

Also, as in the previous period, in the switching unit 170 the first switch sw1 is turned on and the second switch sw2 is turned off so that the pixel 140' is coupled to the data driver 120. Therefore, all the first to third switching elements SW1, SW2, SW3 within the sensing circuit 181 are turned off.

The current $I_D$ corresponding to the programmed voltage can be represented by the following equation.

$$\begin{aligned} I_D &= \frac{1}{2}\mu C_{OX}(W/L)(V_{SG}-V_{th})^2 \\ &= \frac{1}{2}\mu C_{OX}(W/L)\left(ELVDD - \left(ELVDD - \left(\frac{C2}{C1+C2}\right)\right.\right. \\ &\quad \left.\left.\sqrt{\left(\frac{100}{100-\alpha}\right)\left(\frac{\text{Data}}{2^k-1}\right)\frac{2\beta I_{MAX}}{\mu C_{OX}(W/L)}} - V_{th}\right) - V_{th}\right)^2 \\ &= \left(\frac{C2}{C1+C2}\right)^2\left(\frac{100}{100-\alpha}\right)\left(\frac{\text{Data}}{2^k-1}\right)\beta I_{MAX} \end{aligned}$$

As can be appreciated from the above equation, the current input to the organic light emitting diode OLED compensates for the degradation degree of the organic light emitting diode OLED and does not reflect the characteristics of the mobility and threshold voltage of the driving transistor M2'. Therefore, an image with substantially uniform luminance can be displayed irrespective of the degradation of the organic light emitting diode OLED and the mobility of the driving transistor M2'.

With the embodiment of the present invention, it has an advantage that the image with uniform luminance can be displayed irrespective of the degradation of the organic light emitting diode and the threshold voltage/mobility of the driving transistor.

What is claimed is:

1. An organic light emitting display comprising:

a plurality of pixels at crossing portions of data lines, scan lines, and emission control lines, each of the plurality of pixels comprising an organic light emitting diode for emitting light and a driving transistor for driving the organic light emitting diode;

a sensor for sensing degradation information of the organic light emitting diodes and mobility information of the driving transistors;

a converter for storing the degradation information of the organic light emitting diodes and the mobility information of the driving transistors and for converting input data to corrected data by utilizing the degradation information and the mobility information; and a data driver for receiving the corrected data output from the converter and for generating data signals utilizing the corrected data to be supplied to the plurality of pixels via the data lines;

wherein the sensor comprises sensing circuits, wherein each sensing circuit corresponds to a corresponding one of the data lines;

wherein each of the sensing circuits comprises:

a current source unit for supplying a first current to a corresponding one of the plurality of pixels;

a first current sink unit for sinking a second current from said corresponding one of the plurality of pixels; and a second current sink unit for sinking a third current from said corresponding one of the plurality of pixels.

2. The organic light emitting display as claimed in claim 1, further comprising a switching unit for selectively coupling the sensor or the data driver to the data lines.

3. The organic light emitting display as claimed in claim 2, wherein the switching unit comprises a pair of switches for each one of the data lines, the pair of switches comprising a first switch between the data driver and a corresponding one of the data lines and configured to be turned on when the data signals are supplied; and a second switch between the sensor and the corresponding one of the data lines and configured to be turned on when the degradation information and the mobility information are sensed.

4. The organic light emitting display as claimed in claim 1, further comprising at least one analog-digital converter for converting the degradation information of the organic light emitting diode to a first digital value and converting the mobility information of the driving transistor to a second digital value.

5. The organic light emitting display as claimed in claim 4, wherein the converter comprises:

a memory for storing the first digital value and the second digital value; and a conversion circuit for converting the input data to the corrected data utilizing the first digital value and the second digital value stored in the memory so as to display an image with substantially uniform luminance irrespective of degradation of the organic light emitting diode and mobility of the driving transistor.

6. The organic light emitting display as claimed in claim 1, wherein each of the sensing circuits further comprises a plurality of switching elements coupled to the first and second current sink units.

7. The organic light emitting display as claimed in claim 1, wherein the third current corresponds to 4j times the second current, where j is an integer.

8. The organic light emitting display as claimed in claim 1, wherein each of the plurality of pixels further comprises:

a first transistor coupled between a corresponding one of the data lines and a first node, the first transistor having a gate electrode coupled to a corresponding one of the scan lines, wherein the driving transistor is a second transistor having a gate electrode coupled to a second node and having a first electrode coupled to a first power supply;

a third transistor coupled between a second electrode of the second transistor and an anode electrode of the organic light emitting diode, the third transistor having a gate electrode coupled to a corresponding one of the emission control lines;

a fourth transistor coupled between the corresponding one of the data lines and a second electrode of the third transistor, the fourth transistor having a gate electrode coupled to a sensing line;

a fifth transistor coupled between the gate electrode and the second electrode of the second transistor, the fifth transistor having a gate electrode coupled to a previous scan line among the scan lines;

a sixth transistor coupled between a reference voltage source and the first node, the sixth transistor having a gate electrode coupled to the previous scan line;

a first capacitor coupled between the first power supply and the second node; and a second capacitor coupled between the first node and the second node.

9. The organic light emitting display as claimed in claim 8, wherein the first, second, third, fourth, fifth and sixth transistors comprise PMOS transistors.

10. The organic light emitting display as claimed in claim 9, wherein an emission control signal supplied to the emission control lines is applied at a high level in a period where a voltage corresponding to a corresponding one of the data signals is charged in the first and second capacitors, a period where a threshold voltage of the second transistor is stored, and a period where the degradation information of the organic light emitting diode is sensed.

11. The organic light emitting display as claimed in claim 9, wherein a sensing signal supplied to the sensing line is applied at a low level in a period where the degradation information of the organic light emitting diode is sensed and a period where the mobility information of the second transistor is sensed.

12. The organic light emitting display as claimed in claim 8, wherein a voltage of the reference voltage source has substantially the same voltage level as a voltage of power from the first power supply.

13. The organic light emitting display as claimed in claim 1, wherein each of the plurality of pixels further comprises:

a first transistor coupled between a corresponding one of the data lines and a first node, the first transistor having a gate electrode coupled to a corresponding one of the scan lines, wherein the driving transistor is a second transistor having a gate electrode coupled to a second node and having a first electrode coupled to a first power supply;

a third transistor coupled between a second electrode of the second transistor and an anode electrode of the organic light emitting diode, the third transistor having a gate electrode coupled to a corresponding one of the emission control lines;

a fourth transistor coupled between the corresponding one of the data lines and a second electrode of the third transistor, the fourth transistor having a gate electrode coupled to a sensing line;

a fifth transistor coupled between the gate electrode and the second electrode of the second transistor, the fifth transistor having a gate electrode coupled to the corresponding one of the scan lines;

a sixth transistor coupled between a reference voltage source or a control line and the first node, the sixth transistor having a gate electrode coupled to the corresponding one of the emission control lines;

a switching element for coupling a first electrode of the sixth transistor to the reference voltage source or the control line;

a first capacitor coupled between the first power supply and the second node;

a second capacitor coupled between the first node and the second node; and a seventh transistor coupled between the first electrode of the sixth transistor and the gate electrode of the second transistor, the seventh transistor having a gate electrode coupled to a previous scan line among the scan lines.

14. The organic light emitting display as claimed in claim 13, wherein the first, second, third, fourth, fifth, sixth and seventh transistors comprise PMOS transistors.

15. The organic light emitting display as claimed in claim 14, wherein an emission control signal supplied to the emission control lines is applied at a high level in a period where the degradation information on the organic light emitting diode is sensed, a period where the mobility information of the second transistor is sensed, an initialization period, a period where a threshold voltage of the second transistor is stored, and a period where a voltage corresponding to a data signal among the data signals is charged.

16. The organic light emitting display as claimed in claim 14, wherein a sensing signal supplied to the sensing line is applied at a low level in a period where the degradation information of the organic light emitting diode is sensed.

17. The organic light emitting display as claimed in claim 13, wherein the switching element is turned on in a period where the mobility information of the second transistor is sensed and a corresponding one of the plurality of pixels is coupled to the sensor through a separate control line that is different from the data line.

18. The organic light emitting display as claimed in claim 13, wherein a voltage of the reference voltage source has substantially the same voltage level as a voltage of a ground power supply.

19. A driving method of an organic light emitting display, the method comprising:

a) generating a first voltage while supplying a first current to organic light emitting diodes included in a plurality of pixels;

b) converting the first voltage to a first digital value and storing the first digital value in a memory;

c) generating a second voltage while sinking a second current via driving transistors in the plurality of pixels;

d) generating a third voltage while sinking a third current via the driving transistors in the plurality of pixels;

e) converting information corresponding to a difference between the second voltage and the third voltage to a second digital value and storing the second digital value in the memory;

f) converting input data to corrected data to display an image with substantially uniform luminance utilizing the first and second digital values stored in the memory irrespective of degradation of the organic light emitting diodes and mobility of the driving transistors; and g) providing data signals corresponding to the corrected data to data lines.

20. The method as claimed in claim 19, wherein a)-g) are performed in a non-display period from after power from a power supply is applied to the organic light emitting display to before the image is displayed and are performed each time power from the power supply is applied to the organic light emitting display.

21. The method as claimed in claim 19, wherein c)-e) are performed before the organic light emitting display device is distributed as a product so that performance results are pre-stored and utilizes the pre-stored performance results each time power from a power supply is applied to the organic light emitting display.

22. The method as claimed in claim 19, wherein the third current corresponds to 4j times the second current, wherein j is an integer.

23. The method as claimed in claim 19, wherein the first voltage comprises degradation information of the organic light emitting diode.

24. The method as claimed in claim 19, wherein the difference between the second voltage and the third voltage comprises mobility information of the driving transistor.

25. A driving method of an organic light emitting display, the method comprising:

measuring voltage change across organic light emitting diodes in a plurality of pixels by utilizing a first current and storing the voltage change;

sequentially sinking a second current and a third current via driving transistors in the plurality of pixels to measure a second voltage corresponding to the second current and a third voltage corresponding to the third current and to store a difference between the second voltage and the third voltage;

converting input data to corrected data utilizing the voltage change and the difference between the second and third voltages to compensate for degradation of the organic light emitting diodes and a variance in mobility among the driving transistors; and applying data signals corresponding to the corrected data to the plurality of pixels during a display period and compensating for threshold voltages of the driving transistors in respective pixel circuits of the plurality of pixels through an initialization process.

26. The method as claimed in claim 25, wherein said measuring voltage change of organic light emitting diodes in the plurality of pixels and storing the voltage change is performed in a non-display period from after power from a power supply is applied to the organic light emitting display to before an image is displayed, and are performed each time the power from the power supply is applied to the organic light emitting display.

27. The method as claimed in claim 25, wherein said measuring a second voltage and a third voltage and storing the difference between the second voltage and the third voltage are performed before the organic light emitting display device is distributed as a product so that performance results are pre-stored and utilizes the pre-stored performance results each time power from a power supply is applied to the organic light emitting display.

28. The method as claimed in claim 25, wherein the driving transistor is diode-connected during the initialization process so that a voltage of a gate electrode of the driving transistor is substantially the same as a voltage of a cathode electrode of the organic light emitting diode.

29. The method as claimed in claim 25, wherein the voltage of a gate electrode of the driving transistor is substantially the same as a reference voltage through the initialization process.

30. The method as claimed in claim 29, wherein the reference voltage has substantially the same voltage value as a ground power supply.

* * * * *